US010203638B2

(12) United States Patent
Shindo

(10) Patent No.: US 10,203,638 B2
(45) Date of Patent: Feb. 12, 2019

(54) IMAGE FORMING APPARATUS

(71) Applicant: CANON KABUSHIKI KAISHA, Tokyo (JP)

(72) Inventor: Yukihiro Shindo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/492,158

(22) Filed: Apr. 20, 2017

(65) Prior Publication Data

US 2017/0315481 A1 Nov. 2, 2017

(30) Foreign Application Priority Data

Apr. 27, 2016 (JP) ..... 2016-089891
Oct. 27, 2016 (JP) ..... 2016-210837

(51) Int. Cl.
*G03G 15/20* (2006.01)
*G03G 21/20* (2006.01)
*G03G 15/00* (2006.01)

(52) U.S. Cl.
CPC ..... *G03G 15/2039* (2013.01); *G03G 21/203* (2013.01); *G03G 15/5062* (2013.01); *G03G 15/556* (2013.01); *G03G 2215/00772* (2013.01); *G03G 2215/00776* (2013.01)

(58) Field of Classification Search
CPC ..... G03G 15/2039; G03G 15/205; G03G 15/2078; G03G 15/50; G03G 15/5041; G03G 21/20; G03G 21/203; G03G 2215/00037; G03G 2215/00071
USPC ..... 399/67, 69, 97, 320
See application file for complete search history.

(56) References Cited

U.S. PATENT DOCUMENTS 5,138,379 A * 8/1992 Kanazashi ..... G03G 15/2064 399/331
9,075,356 B2 7/2015 Ooyanagi
2010/0040386 A1* 2/2010 Mizutani ..... G03G 15/161 399/44
2015/0168886 A1* 6/2015 Tanaka ..... G03G 15/5025 399/69

FOREIGN PATENT DOCUMENTS

JP 2000-047509 A 2/2000
JP 2000-221831 A 8/2000
JP 2014-074894 A 4/2014

* cited by examiner

*Primary Examiner* — Benjamin R Schmitt
(74) *Attorney, Agent, or Firm* — Venable LLP

(57) ABSTRACT

An image forming apparatus analyzes image data and detects a first area and a second area in the image data. The first area is an area in which a toner application amount per unit area is greater than a first threshold value and less than a second threshold value, and the second area is an area in which a toner application amount per unit area is greater than a third threshold value that is greater than the second threshold value. The image forming apparatus sets a target fixing temperature for fixing toner to a sheet based on the analyzing of the image data such that the target fixing temperature is set to be higher in a case in which one of the first area and the second area is detected than in a case in which none of the first area and the second area is detected.

14 Claims, 23 Drawing Sheets

| ENVIRONMENT | AMOUNT OF APPLIED TONER | FIXING TEMPERATURE | CLEANING REQUEST FREQUENCY |
|---|---|---|---|
| HIGH TEMPERATURE· HIGH HUMIDITY | LOW:50% (LARGE AREA) | NORMAL +3°C | NORMAL |
| OTHER | LOW:50% (LARGE AREA) | NORMAL | 10% UP |

*TEMPERATURE NORMALLY CHANGES DEPENDING ON ENVIRONMENT

FIG. 14

| ENVIRONMENT | AMOUNT OF APPLIED TONER | FIXING TEMPERATURE | CLEANING REQUEST FREQUENCY |
|---|---|---|---|
| HIGH TEMPERATURE·HIGH HUMIDITY | LOW:50% (LARGE AREA) | NORMAL +3°C | NORMAL |
| | HIGH:200% | NORMAL | NORMAL |
| 1401 | HIGH-SATURATION PRINT MODE:230% | NORMAL +5°C | NORMAL |
| | MIXED ·LOW:50%(LARGE AREA) ·HIGH:200% | NORMAL +3°C | NORMAL |
| 1402 | MIXED ·LOW:50%(LARGE AREA) ·HIGH-SATURATION PRINT MODE:230% | NORMAL +5°C | 5% UP |
| OTHER | LOW:50% (LARGE AREA) | NORMAL | 10% UP |
| | HIGH:200% | NORMAL | NORMAL |
| | HIGH-SATURATION PRINT MODE:230% | NORMAL +3°C | NORMAL |
| | MIXED ·LOW:50%(LARGE AREA) ·HIGH:200% | NORMAL | 10% UP |
| | MIXED ·LOW:50%(LARGE AREA) ·HIGH-SATURATION PRINT MODE:230% | NORMAL +3°C | 15% UP |

*MIXING GIVES PRIORITY TO CONDITION WITH HIGHER TEMPERATURE
*NORMAL TEMPERATURE CHANGES DEPENDING ON ENVIRONMENTAL CONDITION

IMAGE FORMING APPARATUS

BACKGROUND OF THE INVENTION

Field of the Invention

The present invention relates to an image forming apparatus.

Description of the Related Art

An image forming apparatus which forms an image by thermally fixing a toner image formed by an electrophotographic method to a printing paper decides a fixing temperature of a fixing unit in accordance with an amount of color material (toner amount) per unit area loaded on the printing paper. Normally, the maximum amount of color material that can be loaded on the printing paper per unit area is decided in advance, and then the temperature of the fixing unit is controlled such that an image transferred with that maximum amount of color material can be fixed reliably. In addition to this, various methods of analyzing image data and controlling a fixing temperature in accordance with the image data have also been proposed. For example, Japanese Patent Laid-Open No. 2014-074894 has described a method of finely controlling a fixing temperature in accordance with an area of an amount of toner applied area equal to or larger than a predetermined amount. Japanese Patent Laid-Open No. 2000-221831 has described a method of obtaining the characteristics (characters, a graph, a halftone, and many high-density portions) of an image from the relationship between image area and the distribution ratio of each pixel density, and adjusting a fixing temperature in accordance with the characteristics. On the other hand, if the fixing unit cannot be operated at an appropriate temperature relative to the amount of applied toner, hot offset or cold offset occurs, soiling the fixing unit with offset toner. To cope with this, Japanese Patent Laid-Open No. 2000-47509 has described a cleaning method for a fixing unit of passing blank paper in order to clean the fixing unit and adhering dirt to the blank paper for cleaning.

As in Japanese Patent Laid-Open No. 2014-074894, however, a method of controlling the fixing unit at a fixing temperature suitable for a large amount of toner applied area on which toner of the predetermined amount or more is loaded cannot perform control at a fixing temperature suitable for a small amount of toner applied area having a small amount of applied toner. Consequently, an excessive heat amount may be obtained in the small amount of toner applied area, decreasing fixation. The small amount of toner applied area (the amount of applied toner is less than about 70% has a low halftone-dot density in a local region, increasing the contact surface between a heating roller and paper, evaporating water of the paper at the time of fixing, and causing a heat loss. At this time, in an environment having a high water content of the paper, the heat amount lost when evaporating the water is large, making it impossible to obtain a heat amount needed to melt toner. This may bring about density unevenness in a page surface, causing an image error.

On the contrary, in an environment having a low water content of the paper, the heat amount lost when evaporating the water is small. Thus, a heat amount controlled in the large amount of toner applied area becomes excessive for the small amount of toner applied area.

A method of controlling a fixing temperature by roughly analyzing the characteristics of image data to be printed in Japanese Patent Laid-Open No. 2000-221831 does not accurately determine and control whether there is a small amount of toner applied area (the amount of applied toner is less than about 70%) having a large area in which an image error is conspicuous. Consequently, the temperature of a fixing unit is increased more than needed, making it impossible to suppress a heat amount intended to be reduced by temperature control according to a large amount of toner applied area, usage of low-melting-point toner, or the like.

SUMMARY OF THE INVENTION

An aspect of the present invention is to eliminate the above-mentioned problems with the conventional techniques.

A feature of the present invention is to provide a technique of reducing occurrence of an image error by controlling the temperature of a fixing unit when fixing printing paper including a toner applied region in which an amount of toner to be transferred is smaller than a predetermined value.

According to a first aspect, the present invention provides an image forming apparatus comprising a receiving unit that receives image data, an image forming unit that forms a toner image on a sheet based on the image data received by the receiving unit, a fixing unit that thermally fixes, to the sheet, the toner image formed by the image forming unit, a temperature control unit, an environment sensor that senses an ambient state, a memory device that stores a set of instructions, and at least one processor that executes instructions out of the instructions to set a fixing temperature and control temperature of the fixing unit based on the set fixing temperature, wherein the at least one processor that further executes instructions out of the instructions to analyze the image data received by the receiving unit and determine whether or not there is a toner applied region in which an amount of toner to be transferred to the sheet is larger than a first threshold and smaller than a second threshold, when it is determined that there is not the toner applied region, set the fixing temperature of the fixing unit to a first temperature, and when it is determined that there is the toner applied region and the ambient state sensed by the environment sensor indicates a high-humidity environment, set the fixing temperature of the fixing unit to a second temperature higher than the first temperature.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 14 depicts a view illustrating an example of a table for explaining the relationship among an amount of applied toner, temperature control of a fixing unit, and a cleaning request frequency according to a second embodiment;

DESCRIPTION OF THE EMBODIMENTS

Embodiments of the present invention will now be described hereafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

In embodiments to be described below, an explanation of an image forming apparatus which performs temperature control and cleaning control of a fixing unit by sensing, based on image data, whether there is a small amount of toner applied area having a predetermined area or more will be given.

First Embodiment

Figure 1:
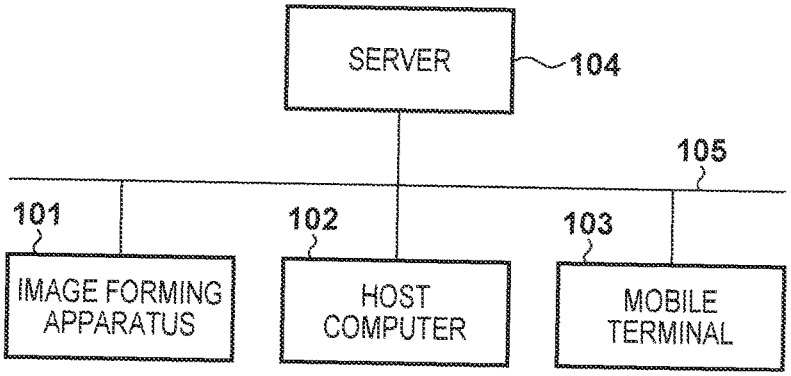
FIG. 1 is a diagram for explaining the arrangement of a system including an image forming apparatus according to a first embodiment.

FIG. 1 is a diagram for explaining the arrangement of a system including an image forming apparatus 101 according to the first embodiment of the present invention.

For example, as will be described later with reference to FIG. 2, this image forming apparatus 101 forms an image in an electrophotographic process. Further, the image forming apparatus 101 senses whether there is a small amount of toner applied area having a predetermined area or more from input data of an image to be formed, and performs cleaning control and temperature control of a fixing unit based on the sensing result. Note that the fixing unit fixes an unfixed toner image to paper. Note that the small amount of toner applied area is, for example, a region in which an amount of applied toner (transfer material) is less than about 70%, as described above. The image forming apparatus 101 receives image data from a host computer 102, a mobile terminal 103, a server 104, another image processing apparatus (not shown), or the like via a network 105 and performs printing (image formation) (including reception and print of FAX). Image data obtained by reading a document by an image reading apparatus (scanner) attached to the image forming apparatus 101 can be transmitted to the host computer 102, the mobile terminal 103, and the server 104 via the network 105. It is further possible, by printing the image data obtained by reading the document by utilizing a print unit attached to the image forming apparatus 101, to implement a copy operation.

In a description below, an example will be described in which it is sensed whether there is the small amount of toner applied area having the predetermined area or more, and the temperature control and the cleaning control of the fixing unit are performed based on the sensing result. However, the present invention is not limited to such an arrangement. For example, the host computer 102 serving as a transmission source of the image data may perform instructions or the like to the image forming apparatus such as sensing of the small amount of toner applied area having the predetermined area or more and cleaning/fixing temperature control. Alternatively, the image forming apparatus 101 and the host computer 102 serving as the transmission source of the image data, the mobile terminal 103, the server 104, and the like may cooperate with each other in performing this process in a distributed manner.

The arrangement of the image forming apparatus 101 will now be described.

Figure 2:
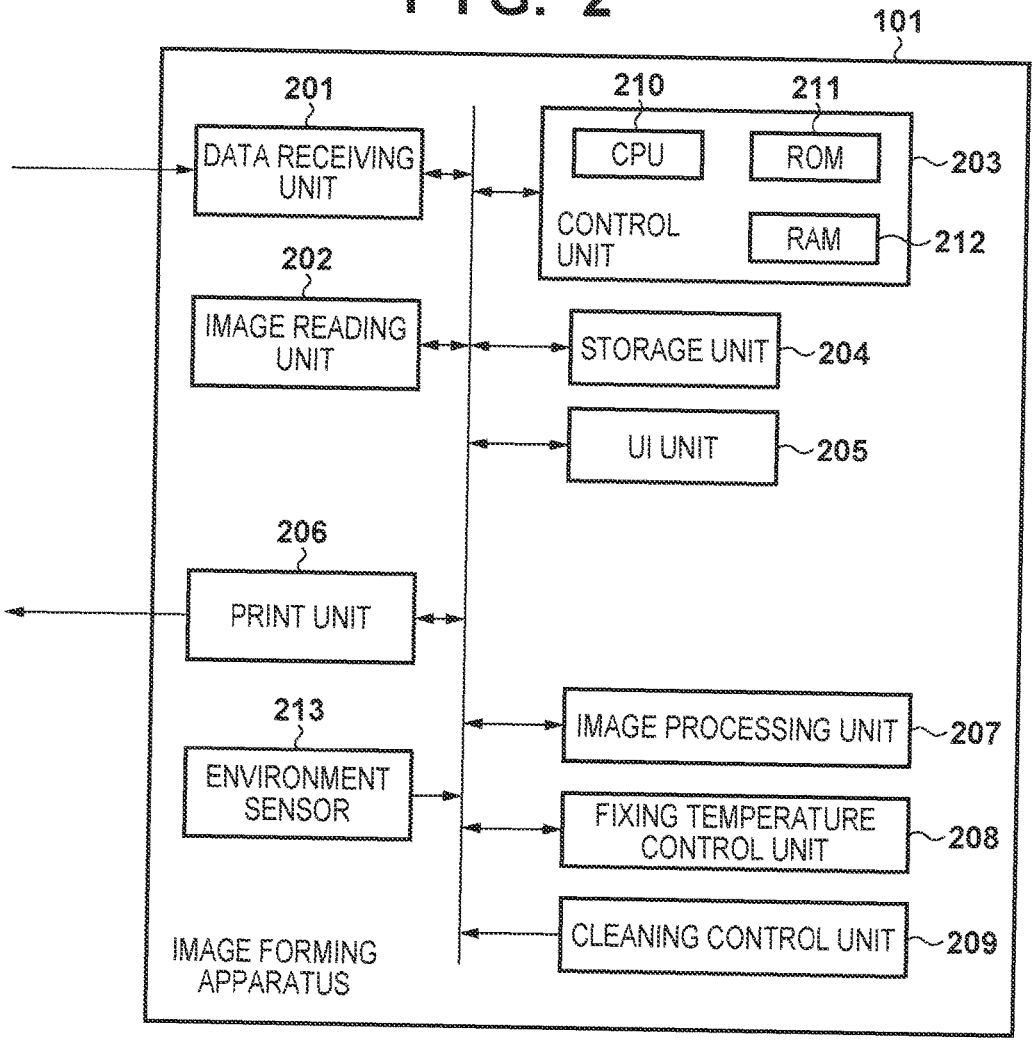
FIG. 2 is a block diagram for explaining the arrangement of the image forming apparatus according to the first embodiment.

FIG. 2 is a block diagram for explaining the arrangement of the image forming apparatus 101 according to the first embodiment.

The image forming apparatus 101 includes a data receiving unit (receiving unit) 201, an image reading unit 202, a control unit 203, a storage unit 204, a UI (User Interface)

unit 205, a print unit 206, an image processing unit 207, a fixing temperature control unit 208, and a cleaning control unit 209. For example, the data receiving unit 201 receives and inputs, via the network 105, print data transmitted from the server 104. The image reading unit 202 includes the scanner, reads a document image, and outputs its image data. The control unit 203 controls the operation of this image forming apparatus 101 and includes a CPU 210, a ROM 211, and a RAM 212. The CPU 210 performs a process shown in each flowchart to be described later by executing programs stored in the ROM 211. The storage unit 204 can store, for example, a large amount of data such as a hard disk drive (HDD). The CPU 210 may be configured to deploy the programs stored in this storage unit 204 to the RAM 212 and execute the deployed program to perform the processes to be described later. The UI unit 205 includes an operation panel and a display unit, and displays a message to a user or accepts an operation instruction by the user. Note that this UI unit 205 may have a touch panel function. The print unit 206 is a printer engine and forms an image on paper by an electrophotographic method here.

The image processing unit 207 senses whether there is the small amount of toner applied area having the predetermined area or more from the image data. Then, upon receiving the sensing result from the image processing unit 207, the fixing temperature control unit 208 performs the temperature control of the fixing unit of the print unit 206. The cleaning control unit 209 controls a cleaning request frequency upon receiving the sensing result from the image processing unit 207 and issues a cleaning request for the UI unit 205 or the print unit 206. Note that the cleaning control here is characterized by controlling the cleaning request frequency, and does not restrict display contents to the UI unit 205 and a cleaning method of the print unit 206. An environment sensor 213 is a sensor which senses a temperature and humidity, and senses the state of an environment in which the image forming apparatus 101 is installed.

Note that here, each of the image processing unit 207, the fixing temperature control unit 208, and the cleaning control unit 209 is not a processing unit such as specialized hardware, but may be configured to implement its function by, for example, causing the CPU 210 to execute the above-described programs.

Function setting at the time of printing will now be described.

Figure 5:
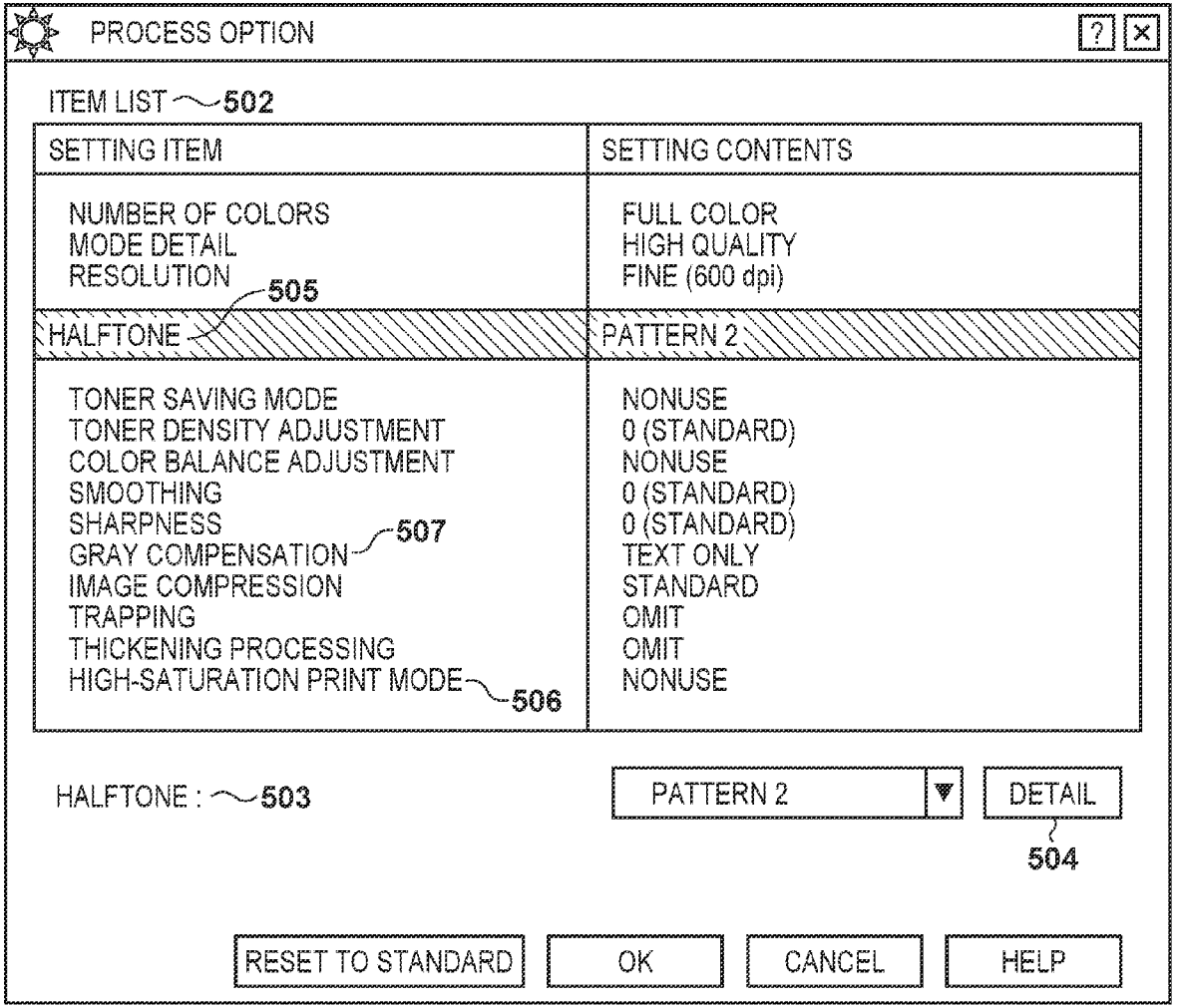
FIG. 5 depicts a view showing an example of a function setting screen displayed in a UI unit of the image forming apparatus according to the first embodiment.

FIG. 5 depicts a view showing an example of a function setting screen displayed in the UI unit 205 of the image forming apparatus 101 according to the first embodiment.

In an item list 502, function setting items that can be designated as an option and a list of current setting contents are displayed. Then, an item selected in the item list 502 (a "halftone" is selected here) is displayed in a selection item 503, making it possible to change the setting contents. Note that in a function capable of setting a detail, a detail button 504 is displayed, and the detail can be set from a detail setting window of each function (not shown) activated and displayed by pressing this button 504.

When a high-saturation print mode 506 is selected in the item list 502, it is possible to change a restriction on the amount of applied toner per unit area and print a high-saturation image with higher saturation. As in FIG. 5, when the high-saturation print mode 506 is set to "nonuse", the amount of applied toner is restricted to 200% because of energy saving, a running cost, productivity, and the like. When the high-saturation print mode 506 is set to "use", the amount of applied toner can be increased up to 230% by increasing the heat amount of the fixing unit, making it possible to print the high-saturation image with higher saturation.

In FIG. 5, a halftone 505 is selected in the item list 502. In this case, the pattern of an image forming method can be changed in accordance with attribute signals (Text, Graphics, Image, and the like) of an object generated from information described in a PDL. Setting of a default is "pattern 2", as shown in FIG. 5. In this "pattern 2", a high line number (near 200 lines) is assigned to a Text attribute in which reproduction of details is important, and a low line number (near 150 lines) is assigned to a Graphics/Image attribute in which stable reproduction of a dot is important. Then, it is possible, by changing setting of this pattern to another pattern, to change a combination of line numbers assigned to the respective attributes, adjust the line number for all the attributes, or assign an error diffusion process.

When gray compensation 507 is selected in the item list 502, an attribute which makes gray compensation can be designated. In the example of FIG. 5, the attribute which makes gray compensation is set to "text only". Note that gray compensation is a function of printing, with achromatic color, the value (RGB equivalence or a signal value near it) of a color image signal which looks gray on a display.

The arrangement of the image processing unit 207 which performs image processing on the image data included in the input print data when the image forming apparatus 101 according to the first embodiment utilizes the print unit 206 to form (print) an image will now be described.

Figure 3:
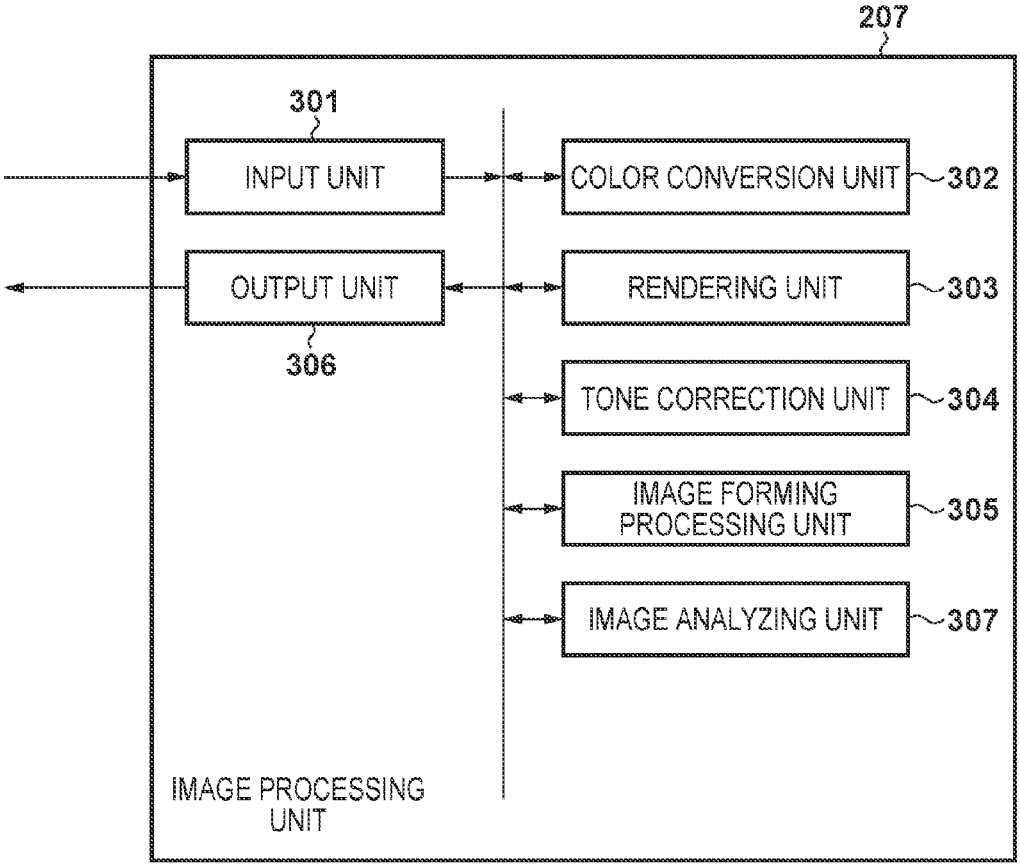
FIG. 3 is a block diagram for explaining the functional arrangement of an image processing unit in the image forming apparatus according to the first embodiment.

FIG. 3 is a block diagram for explaining the functional arrangement of the image processing unit 207 in the image forming apparatus 101 according to the first embodiment. Note that as described above, the function of this image processing unit 207 may be implemented by hardware or may be implemented by causing the CPU 210 to execute the programs.

This image processing unit 207 includes an input unit 301, a color conversion unit 302, a rendering unit 303, a tone correction unit 304, an image forming processing unit 305, an output unit 306, and an image analyzing unit 307. The input unit 301 receives, for example, image data described in the PDL (Page Description Language) included in the print data input by the data receiving unit 201. The color conversion unit 302 performs, for example, color conversion from RGB to YMCK. The rendering unit 303 renders PDL data to convert it into image data. The tone correction unit 304 performs tone correction of the image data. The image forming processing unit 305 creates, for example, information on each color needed for image formation from the converted image data. The image analyzing unit 307 analyzes CMYK data after image forming processing and detects the small amount of toner applied area having the predetermined area or more.

A process of detecting the small amount of toner applied area of the image from the image data by the image analyzing unit 307 will now be described.

Figure 4:
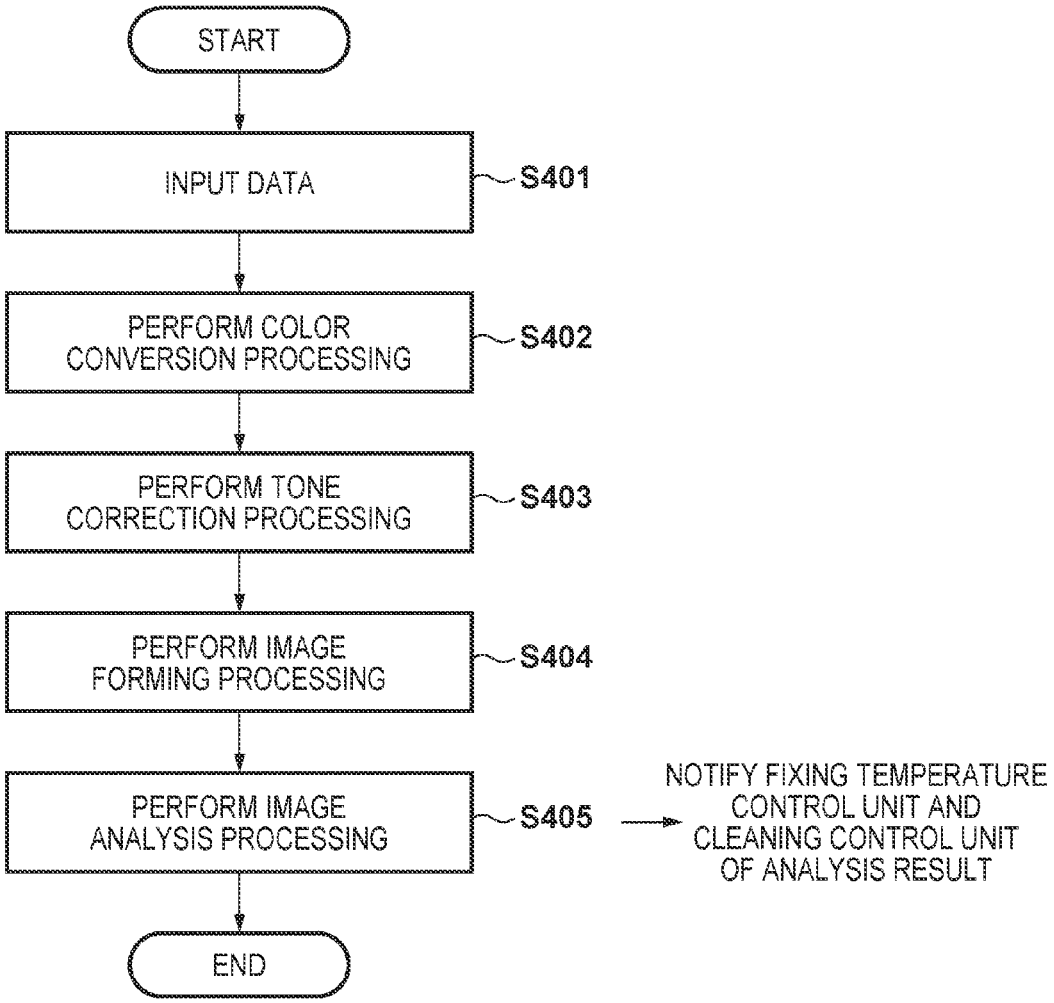
FIG. 4 is a flowchart for describing image processing by the image processing unit according to the first embodiment.

FIG. 4 is a flowchart for describing image processing by the image processing unit 207 according to the first embodiment. An example will be described here in which the CPU 210 of the control unit 203 controls the respective units of the image processing unit 207 according to the programs.

First, in step S401, the CPU 210 outputs document data for print output received by the data receiving unit 201 to the input unit 301 of the image processing unit 207. Then, the process advances to step S402 in which the CPU 210 causes the rendering unit 303 to convert the input document data into raster image data and supply the raster image data to the color conversion unit 302 to perform color conversion processing. At this time, the CPU 210 controls the rendering unit 303 to determine the characteristics (characters, graphics, photographs, and the like) of respective pixels from the PDL data. Then, attribute data such as Text (text), Graphics (graphics), Image (image data), SmallText, ThinLine (thin line), and the like is generated. Then, the generated attribute data is passed to the color conversion unit 302. In step S402, the CPU 210 performs, by the color conversion unit 302, color conversion of the generated RGB data into CMYK data to generate raster image data and the process advances to step S403 in which the CPU 210 passes the image data to the tone correction unit 304. The CPU 210 also passes the attribute data received from the color conversion unit 302 to the tone correction unit 304 to perform tone correction processing.

Note that color conversion from the RGB data to the CMYK data is performed so as not to exceed the maximum amount of applied toner (for example, 200%) printable by the print unit 206. For example, when the high-saturation print mode of the item list 502 in FIG. 5 is set to "use", the maximum amount of applied toner up to 230% is possible. The CPU 210 converts the RGB data into the CMYK data while switching the presence/absence of gray compensation in accordance with the attribute data received from the color conversion unit 302 and the setting of gray compensation in the item list 502.

In this manner, in step S403, the CPU 210 controls the tone correction unit 304 to perform the tone correction processing on the CMYK data in consideration of the tone characteristics of the print unit 206 in the image forming apparatus 101 and passes the processed image data to the image forming processing unit 305. The CPU 210 also controls the tone correction unit 304 to pass the attribute data to the image forming processing unit 305 as well.

Note that the tone characteristics of the print unit 206 vary depending on the image forming method. It is therefore necessary to change the tone correction processing in accordance with the image forming method. Accordingly, the CPU 210 performs the tone correction processing in accordance with the attribute data received by the tone correction unit 304 and the setting of the halftone in the item list 502.

Then, the process advances to step S404 in which the CPU 210 controls the image forming processing unit 305 to perform a process such as an error diffusion process or screen processing on the CMYK data after tone correction, and passes it to the output unit 306 and the image analyzing unit 307. Then, in step S405, the CPU 210 controls the image analyzing unit 307 to analyze the CMYK data after the above-described process and performs detection processing of the small amount of toner applied area having the predetermined area or more. Then, the CPU 210 transmits that detection result to the fixing temperature control unit 208 and the cleaning control unit 209. Note that the image analysis processing at this time, and fixing temperature control and cleaning control utilizing that result will be described in detail later. Then, the CPU 210 controls the output unit 306 to output the CMYK data processed for image formation to the print unit 206 for printing.

Figure 6:
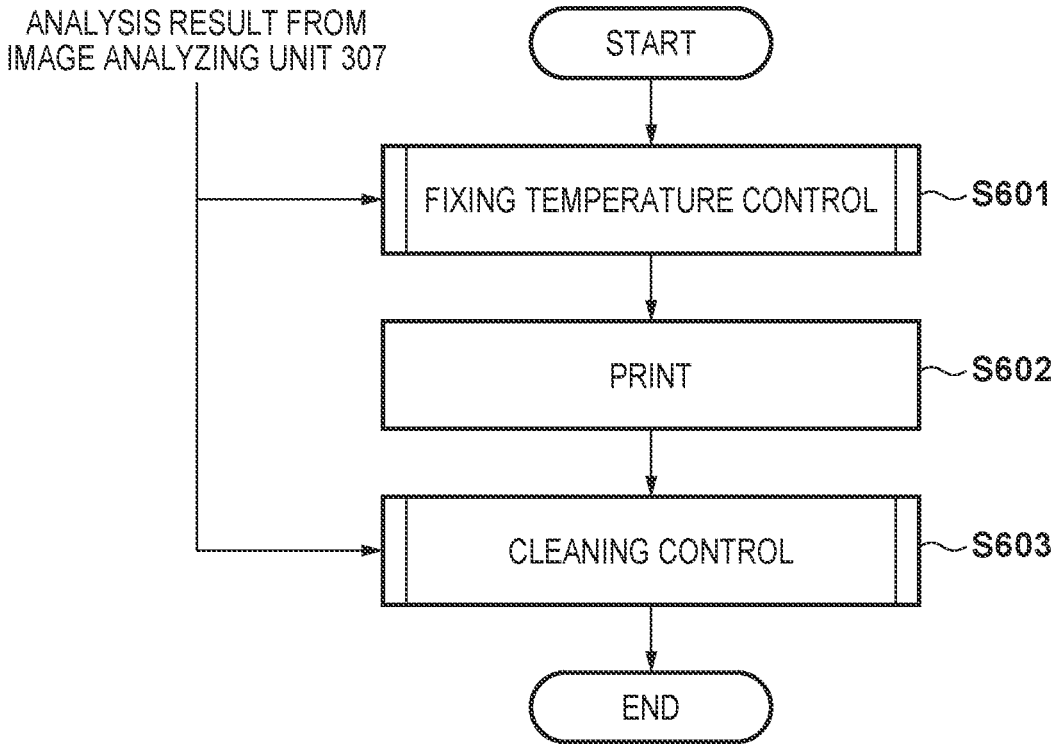
FIG. 6 is a flowchart for explaining a process by the image forming apparatus according to the first embodiment.

FIG. 6 is a flowchart for describing a process by the image forming apparatus 101 according to the first embodiment. This process is achieved by causing the CPU 210 to deploy the programs stored in the storage unit 204 to the RAM 212 and execute them.

First, in step S601, the CPU 210 receives an analysis result of the image data from the image analyzing unit 307 and controls the fixing temperature control unit 208 by using information on the analysis result to control the temperature of the fixing unit on a page basis (on a paper basis). Then, the process advances to step S602 in which the CPU 210 receives the CMYK data for printing output from the output unit 306 of the image processing unit 207 and controls, based on the CMYK data, the print unit 206 to perform fixing at the temperature of the fixing unit according to the analysis result in step S601 for printing. Then, the process advances to step S603 in which the CPU 210 receives the analysis result of the image data from the image analyzing unit 307 and controls, in accordance with information on the analysis result, the frequency of a cleaning request to the cleaning control unit 209. Further, the CPU 210 issues a cleaning request for the UI unit 205 or the print unit 206 as needed, terminating this process.

The analysis processing of analyzing the CMYK data processed for image formation and detecting the small amount of toner applied area having the predetermined area or more by the image analyzing unit 307 in step S405 of FIG. 4 will now be described with reference to FIGS. 7 to 9. Note that as an example, an area having a local amount of applied toner of 10% to about 70% is the small amount of toner applied area, and a region whose area has a predetermined size or more, for example, 10 mm×10 mm or more is detected as the small amount of toner applied region.

Figure 7:
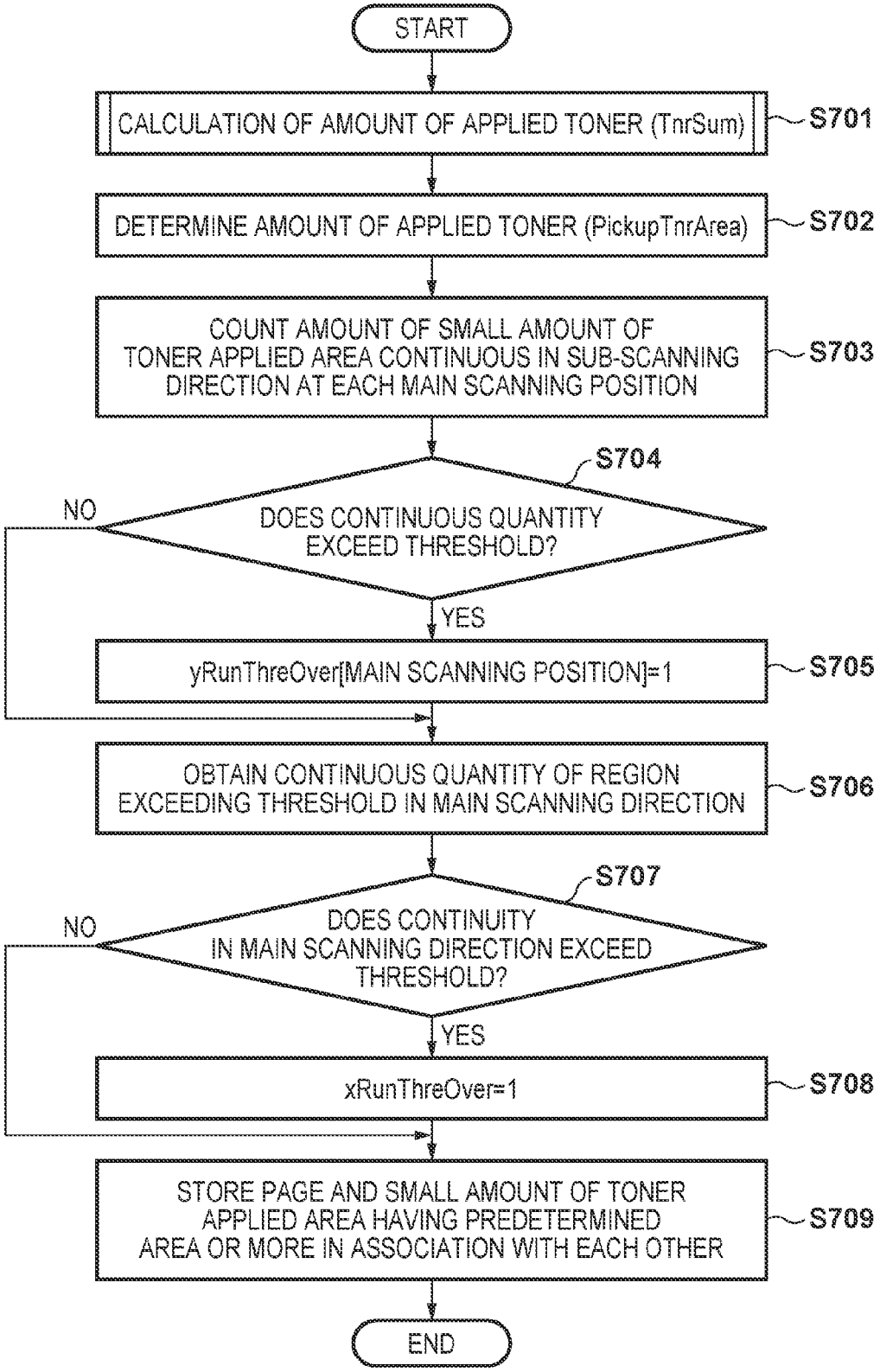
FIG. 7 is a flowchart for describing image analysis processing by an image analyzing unit of the image forming apparatus according to the first embodiment.

FIG. 7 is a flowchart for describing the image analysis processing by the image analyzing unit 307 of the image forming apparatus 101 according to the first embodiment. Note that a description will be given here assuming that the processing shown in this flowchart is implemented by causing the CPU 210 to deploy the programs stored in the storage unit 204 to the RAM 212 and execute the deployed programs.

First, in step S701, the CPU 210 analyzes the CMYK data after the image forming processing received in step S405 of FIG. 4 and calculates an amount of applied toner (TnrSum) for each local region. Note that an influence on fixation by evaporation of water contained in printing paper is decided by the amount of applied toner in this local region. Therefore, this amount of applied toner is calculated at the same resolution as in the image forming processing or at a high resolution of 600 dpi or more. This process will be described later in detail with reference to FIG. 8.

Then, the process advances to step S702 in which the CPU 210 determines whether or not the amount of applied toner (TnrSum) in the local region calculated in step S701 falls within a threshold range designated in advance. If the CPU 210 determines that the amount of applied toner (TnrSum) falls within the threshold range, PickupTnrArea=1 is set. If the CPU 210 determines that the amount of applied toner (TnrSum) does not fall within the threshold range, PickupTnrArea=0 is set. Note that this PickupTnrArea is stored in the RAM 212.

Note that here, 10%<TnrSum<70% is set as an example of the threshold range designated in advance. However, the present invention is not limited to this. In the range of the amount of applied toner (about 0% to 70%) in which the contact surface between the printing paper and a roller of the fixing unit becomes large, a threshold range considering the fact that density unevenness is conspicuous by decreasing the fixation is set. Alternatively, a threshold range considering an amount of applied toner having dirt on the fixing unit by offset toner for concern can be set.

Then, the process advances to step S703 in which the CPU 210 counts, at a main scanning position N, a quantity yRun (main scanning position) of lines with the local region of PickupTnrArea=1 continuous in a sub-scanning direction.

Note that a size having conspicuous poor image quality in the small amount of toner applied area exceeds a millimeter. Therefore, for example, if the resolution of an image is 600 dpi, the number of continuous lines may be counted by performing rough sampling, for example, on the 100-dpi basis or the like at the main scanning position or in the sub-scanning direction. Note that the initial value of N is "1" here, and the continuous quantity of the local region in the sub-scanning direction at each main scanning position is obtained until the value of N becomes the maximum number of pixels in the main scanning direction here. As described above, however, the size having the conspicuous poor image quality in the small amount of toner applied area exceeds the millimeter. Therefore, the continuous quantity may be counted by performing rough sampling, for example, on the 100-dpi basis or the like. The number of continuous lines in a plurality of pixel blocks is thus obtained.

Then, the process advances to step S704 in which the CPU 210 determines the continuous quantity yRun from the number of continuous lines in the plurality of pixel blocks. That is, the CPU 210 determines whether or not there is, out of the continuous quantities yRun (main scanning positions), the continuous quantity yRun exceeding a threshold yRunThre (=10 mm) designated in advance. If there is the continuous quantity yRun exceeding the threshold at this main scanning position here, the process advances to step S705, otherwise the process proceeds to step S706. In step S705, the CPU 210 sets yRunThreOver (main scanning position)=1, then the process advances to step S706. Note that the initial value of this yRunThreOver (main scanning position) is set to "0". Note that this yRunThreOver is stored in the RAM 212.

If the CPU 210 determines that the process in the main scanning direction thus ends, the process advances to step S706 in which the CPU 210 obtains the continuous quantity of a region of yRunThreOver (main scanning position)=1 in the main scanning direction as a result of judging the continuous quantity in the sub-scanning direction. A continuous quantity xRun of a continuous region of rRunThreOver (main scanning position)=1 in the sub-scanning direction continuous in the main scanning direction is counted here. Note that the size having the conspicuous poor image quality in the small amount of toner applied area is defined by the size exceeding the millimeter. Therefore, the continuous quantity may be obtained by performing rough sampling, for example, on the 100-dpi basis or the like in the main scanning direction.

Then, the process advances to step S707 in which the CPU 210 determines whether or not there is, out of the continuous quantities xRun in the main scanning direction, the continuous quantity xRun exceeding a threshold xRunThre (=10 mm) designated in advance. If the CPU 210 determines that there is the continuous quantity in the main scanning direction exceeding the threshold here, the process advances to step S708, otherwise the process advances to step S709. In step S708, the CPU 210 sets xRunThreOver=1, then the process advances to step S709. Note that the initial value of this xRunthreOver is set to "0". Note that this xRunThreOver is stored in the RAM 212. Then, the process advances to step S709 in which based on a result detected in the above-described process, the CPU 210 stores, in the RAM 212, that the page includes the small amount of toner applied area having a predetermined value or more, terminating this processing. Note that if continuous quantities in a plurality of blocks are obtained in steps S703 and S706, the CPU 210 may determine, in corresponding steps S704 and S707, whether the maximum quantity out of the continuous quantities in the plurality of blocks exceeds a threshold or whether at least one of the continuous quantities in the plurality of blocks exceeds the threshold. Alternatively, the number of blocks exceeding the threshold, the continuous quantity of the largest block, or the like may be recorded and stored as the feature amount of the page in step S709 to be used for subsequent temperature control of the fixing unit.

It is thus possible to detect the small amount of toner applied area having a processing area. This makes it possible to determine whether the page includes the small amount of toner applied area having the predetermined area or more when paper printed with the image data of the page is fixed in the subsequent image forming processing.

Figure 9:
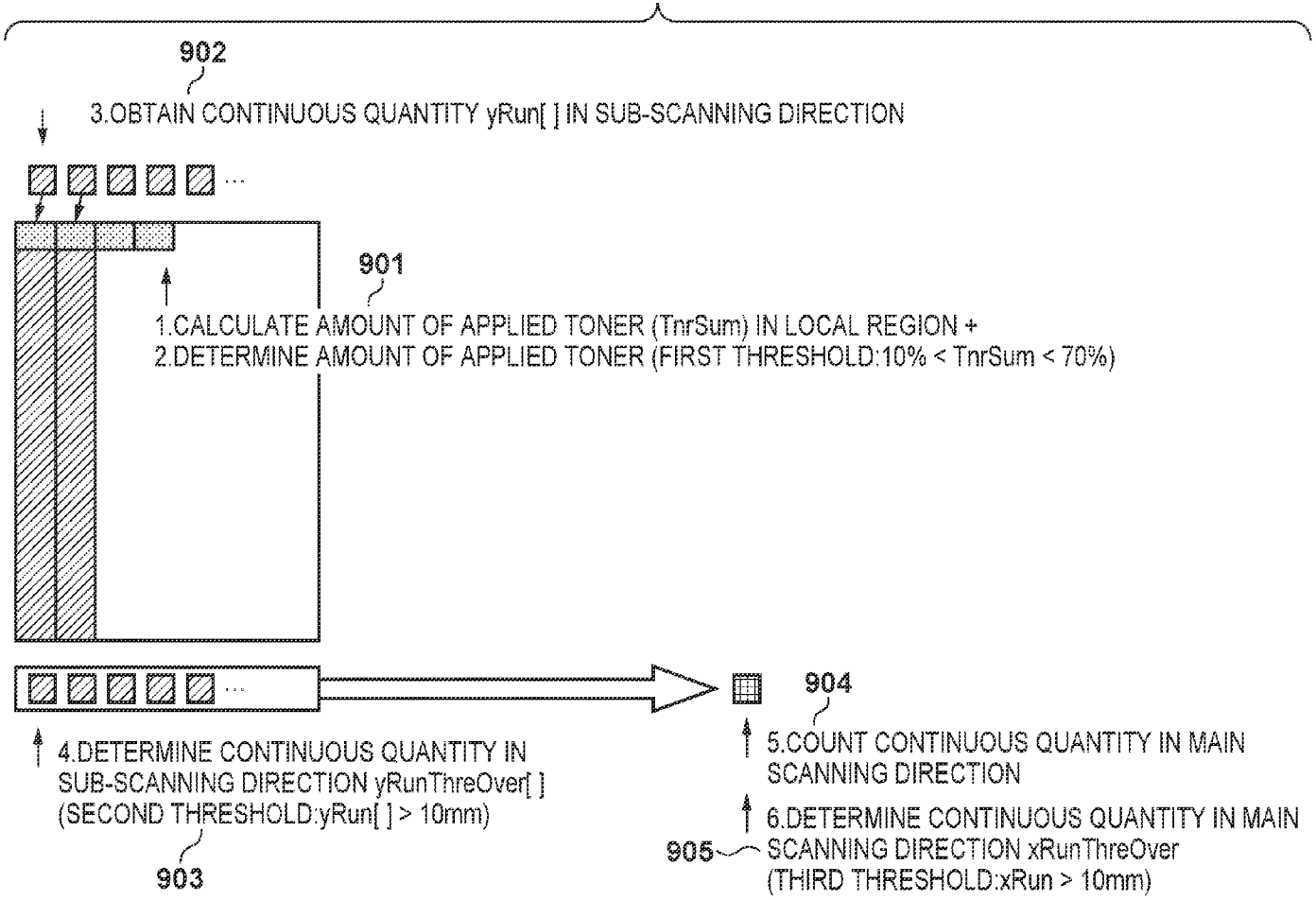
FIG. 9 depicts a view for explaining the overview of a process for obtaining the area of a small amount of toner applied region continuous in a sub-scanning direction and a main scanning direction in the flowchart of FIG. 7.

FIG. 9 depicts a view for explaining the overview of a process for obtaining the area of the small amount of toner applied region continuous in the sub-scanning direction and the main scanning direction in the flowchart of FIG. 7.

As denoted by reference numeral 901, an area included in a region in which the amount of applied toner in the local region is a predetermined small amount of applied toner (for example, 10%<CYMK total sum<70%) is obtained. Then, in reference numeral 902, a continuous quantity of the area delimiting the main scanning positions and continuous in the sub-scanning direction is obtained. Then, a continuous quantity continuous in the main scanning direction is obtained in reference numeral 904 for an area, denoted by reference numeral 903, with the continuous quantity in the sub-scanning direction exceeding a threshold (for example, 10 mm). Then, in reference numeral 905, it is determined whether or not the page includes an area in which the continuous quantity continuous in the main scanning direction becomes equal to or larger than the threshold (for example, 10 mm). Then, if the page includes such a continuous area, the area of that region is obtained, and the temperature of the fixing unit is controlled in accordance with the area.

With the above-described process, it is possible to measure the area from the continuous quantities of the small amount of toner applied area in the sub-scanning direction and the main scanning direction, and to determine whether or not there exists, in the page, the small amount of toner applied region having the predetermined area or more in which a concern for a decrease in fixation is large. Note that if the offset toner continuously occurs at the same main scanning position, the concentration of dirt is obtained easily. Therefore, in the first embodiment, the continuous quantity in the main scanning direction is obtained with respect to an area in which the continuous quantity in the sub-scanning direction is equal to or larger than the threshold with an emphasis on the continuous quantity in the sub-scanning direction. However, the present invention is not limited to this. It is essential only that a determination of whether the page includes the area having the predetermined area of the small amount of toner applied area or more can be made.

Also, in the first embodiment, the image data is analyzed on the page basis. However, the present invention is not limited to this. When a plurality of copies are printed, an analysis result for one copy is temporarily saved in the storage unit 204, and the analysis result saved in the storage unit 204 may be utilized without analyzing the image data for each page when printing is performed repeatedly.

Further, in the first embodiment, each of the continuous quantity in the sub-scanning direction and the continuous quantity in the main scanning direction has the threshold of 10 mm. However, the present invention is not limited to this. An independent threshold may also be set in each of the main scanning direction and the sub-scanning direction. It is only necessary to designate the size having conspicuous density unevenness or a size having continuous occurrence of the offset toner at the same main scanning position and causing concentrated accumulation of dirt.

Furthermore, in the first embodiment, the image analysis processing for density unevenness owing to the shortage of heat amount and the image analysis processing for the dirt by the offset toner owing to the excessive heat amount are not performed separately from each other. However, a determination may be made by setting respective thresholds in accordance with respective applications. Alternatively, as shown in FIG. 15, a heat-amount status for toner changes depending on environmental conditions, and thus a high-temperature/high-humidity environment, an environment other than this, and the like may be determined from environment information received from the environment sensor 213, and the threshold of a region size may be changed accordingly.

For example, as an example of this threshold, since the dirt tends to accumulate when the continuous quantity in the sub-scanning direction is large at the same main scanning position, the size may be, for example, 10 mm×100 mm for a cleaning purpose or if limited to the high-temperature/high-humidity environment, the size may be, for example, 5 mm×5 mm with an emphasis on the density unevenness.

Figure 15:
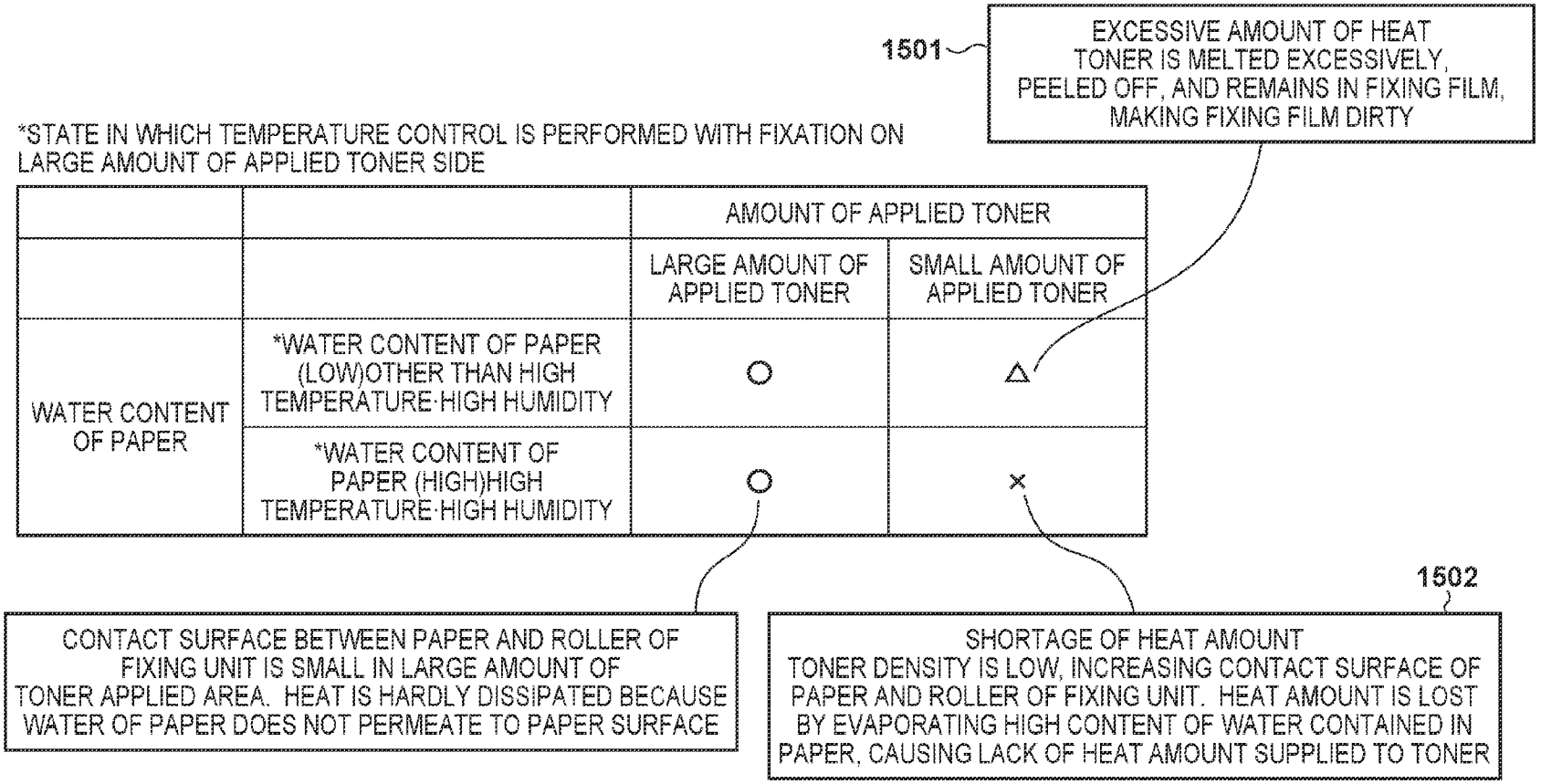
FIG. 15 depicts a view illustrating an example of a table for explaining the relationship between the amount of applied toner and the water content of paper when the temperature control of the fixing unit with respect to a large amount of toner applied area having a large amount of applied toner is performed.

FIG. 15 depicts a view illustrating an example of a table for explaining the relationship between the amount of applied toner and the water content of paper when the temperature control of the fixing unit with respect to the large amount of toner applied (mounted) area having the large amount of applied toner is performed.

○ indicates a case in which there is no problem in this temperature control. In the large amount of toner applied area having the large amount of applied toner, the contact surface between the paper and the roller of the fixing unit is small. Therefore, the water of the paper does not permeate to a paper surface, hardly dissipating heat. Accordingly, at the high temperature and humidity or not at the high temperature and humidity, no problem arises regardless of the water content of the paper.

In contrast, in the small amount of toner applied area having the small amount of applied toner, the contact surface between the paper and the roller of the fixing unit becomes large, largely receiving the influence of the environment and the water content of the paper.

For example, in reference numeral 1501 of FIG. 15, the heat amount becomes excessive because of the small amount of applied toner and the low water content of the paper, causing hot offset in the small amount of toner applied area and making a fixing film dirty. In reference numeral 1502, the heat amount is lacking because of the small amount of applied toner and the high water content of the paper. That is, the heat amount is lost by evaporating the high content of the water contained in the paper, causing the lack of the heat amount supplied to the toner.

Figure 8:
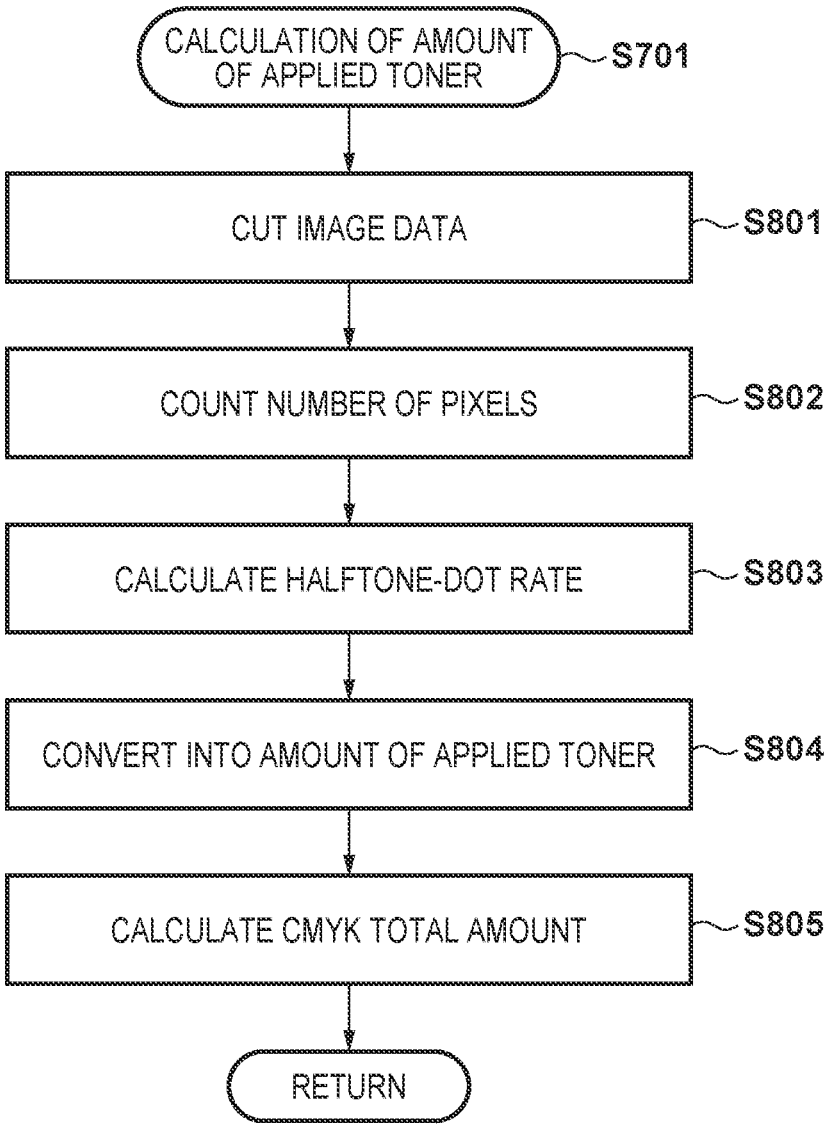
FIG. 8 is a flowchart for describing a process of calculating an amount of applied toner (TnrSum) for each local region in step S701 of FIG. 7.

FIG. 8 is a flowchart for describing the process of calculating the amount of applied toner (TnrSum) for each local region in step S701 of FIG. 7.

In the first embodiment, the image analysis is performed in step S405 of FIG. 4. Therefore, the tone correction processing and the image forming processing are performed on the CMYK data (information on an amount of applied toner for each color) after color conversion, and an image is expressed by area coverage modulation. Accordingly, a halftone-dot rate per unit area is analyzed, and then the amount of applied toner is calculated backward from it.

First, in step S801, the CPU 210 cuts, from the CMYK data after the image forming processing received by the image analyzing unit 307 in step S405 of FIG. 4, the image data for each predetermined region corresponding to the local region in order to calculate the amount of applied toner in the local region. Then, the process advances to step S802 in which the CPU 210 counts the number of pixels included in the image data present in the region. Then, the process advances to step S803 in which the CPU 210 obtains the halftone-dot rate from the number of pixels for the area of the region. That is, the halftone-dot rate is calculated by setting a state in which the region is painted solid in a single color as 100%. Then, the process advances to step S804 in which the CPU 210 generates a table inversely converted into the amount of applied toner from the halftone-dot rate obtained in step S803 and calculates the amount of applied toner from the halftone-dot rate. The amount of applied toner for each CMYK data is calculated by thus performing the processes in steps S801 to S804 on each data of the CMYK data. Then, the process advances to step S805 in which the CPU 210 calculates the total amount of toner corresponding to the CMYK data in the local region (see FIG. 9) from the amount of applied toner of the CMYK data obtained in step S804, terminating this processing.

Figure 10A:
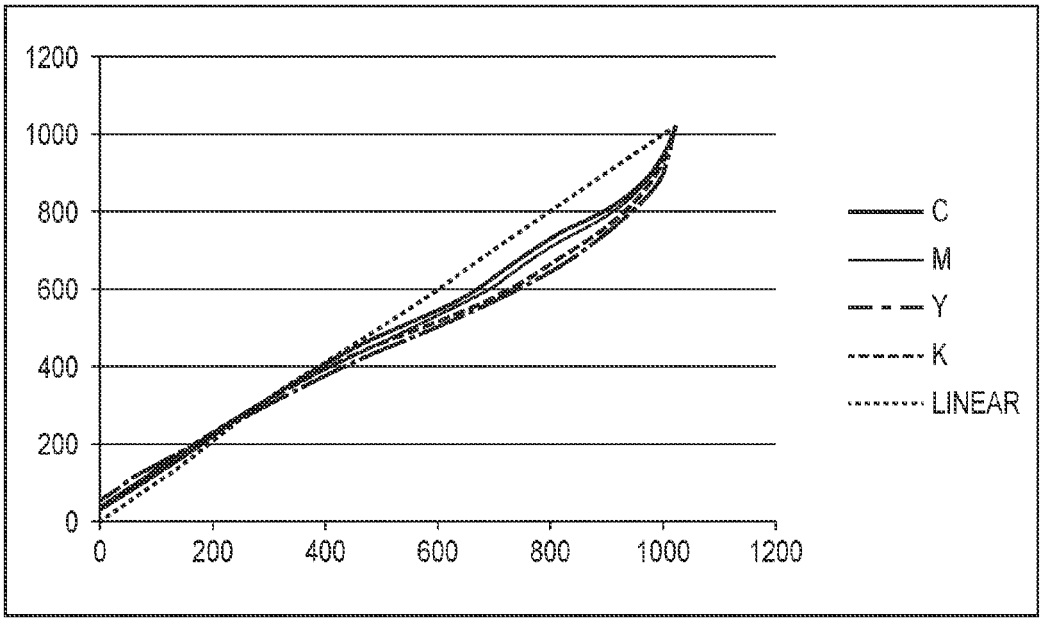
FIGS. 10A to 10C are graphs showing an example of each of a tone correction table, a halftone-dot rate table, and an amount of applied toner conversion table according to the first embodiment.
Figure 10B:
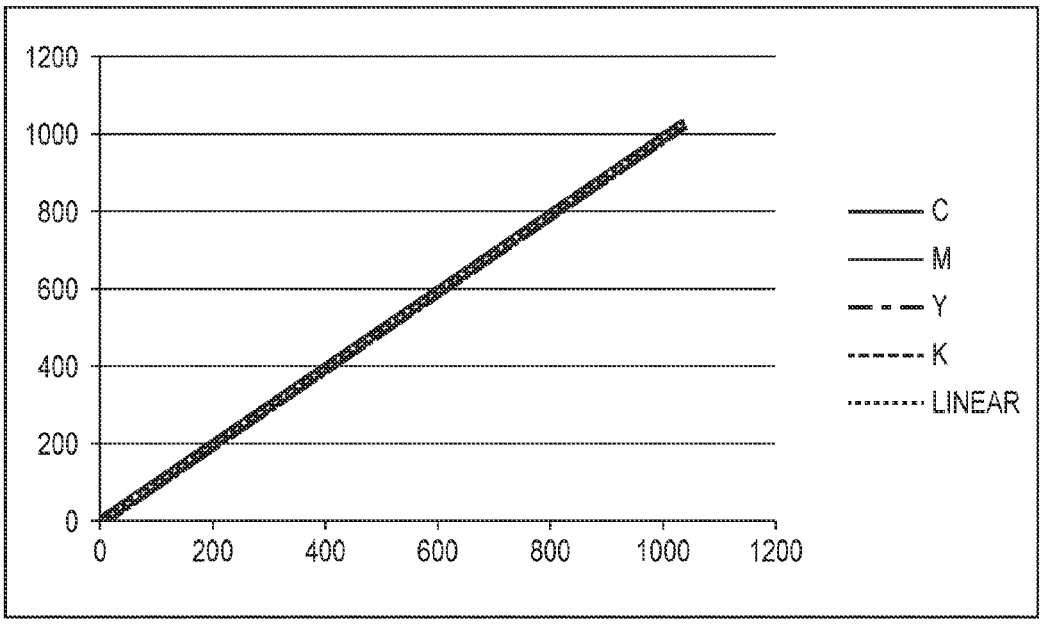
Figures 10C, 11:
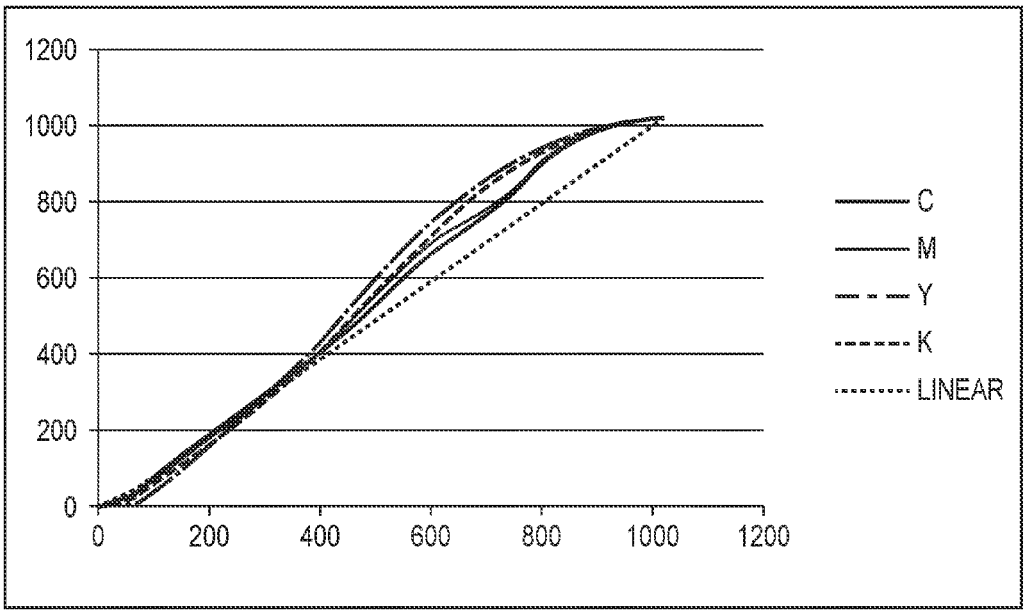
FIG. 11 depicts a view illustrating an example of a table for explaining the relationship among the amount of applied toner, fixing temperature control, and cleaning control according to the first embodiment.

FIGS. 10A to 10C depict views of graphs showing an example of each of a tone correction table, a halftone-dot rate table, and an amount of applied toner conversion table according to the first embodiment.

FIG. 10A shows the example of the tone correction table. This table is used in the tone correction processing in step S403 of FIG. 4 and corrects the tone characteristics of the print unit 206 varied by an environment, durability, device variation, or the like.

FIG. 10B shows the example of the halftone-dot rate table, and the relationships between input multilevel signals and the halftone-dot rate per unit area in conversion from a multilevel (10-bit) tone expression to area coverage modulation by the image forming processing in step S404 of FIG. 4. In FIG. 10B, the halftone-dot rate corresponding to the multilevel signal of each color is in an almost linear relationship.

FIG. 10C shows the example of the amount of applied toner conversion table. This is a table for calculating the amount of applied toner from the halftone-dot rate.

The halftone-dot rate is obtained by multiplying the amount of applied toner by the tone correction table and the halftone-dot rate table. It is therefore possible, by combining the tone correction table and the halftone-dot rate table, and obtaining an inverse conversion thereof, to generate a table for obtaining the amount of applied toner from the halftone-dot rate.

As described above, it is possible to calculate the amount of applied toner for each local region. Note that in the first embodiment, the description has been given as the image analysis processing in step S405 of FIG. 4 is executed after the image forming processing in step S404 of FIG. 4. However, the present invention is not limited to this. For example, the image analysis processing in step S405 may be performed after the color conversion processing in step S402 of FIG. 4. In this case, in the CMYK data after color conversion, an image signal is information on the amount of applied toner. Therefore, the amount of applied toner need not be converted inversely from the halftone-dot rate but can be utilized directly with reference to a pixel value.

FIG. 11 depicts a view illustrating an example of a table for explaining the relationship among the amount of applied toner, fixing temperature control, and cleaning control according to the first embodiment.

In step S601 of FIG. 6 described above, the CPU 210 receives the analysis result of the image data from the image analyzing unit 307, and controls the fixing temperature control unit 208 based on the analysis result and the environment information from the environment sensor 213, performing the fixing temperature control as shown in FIG. 11.

In step S603 of FIG. 6, the CPU 210 receives the analysis result of the image data from the image analyzing unit 307, and controls the cleaning control unit 209 based on the analysis result and the environment information from the environment sensor 213, controlling the frequency at which the cleaning request is issued as shown in FIG. 11.

For example, if the page includes the small amount of toner applied area having the predetermined area in the high-temperature/high-humidity environment, the shortage of heat amount is likely to occur. Therefore, the fixing temperature in the page (paper unit) is increased by 3° C. than usual. This temperature increase according to the presence/absence of the small amount of toner applied area is performed only in a range in which offset is not caused by the excessive heat amount in the large amount of toner applied area.

In another environment, the temperature is not increased because of the excessive heat amount. Then, the cleaning request frequency is increased by 10%. Note that in the other environment, the temperature is not decreased in accordance with the small amount of toner applied area so as not to cause the shortage of heat amount if the large amount of toner applied area exists. This is because the influence of a decrease in fixation in the large amount of toner applied area is larger than in the small amount of toner applied area.

Figure 12:
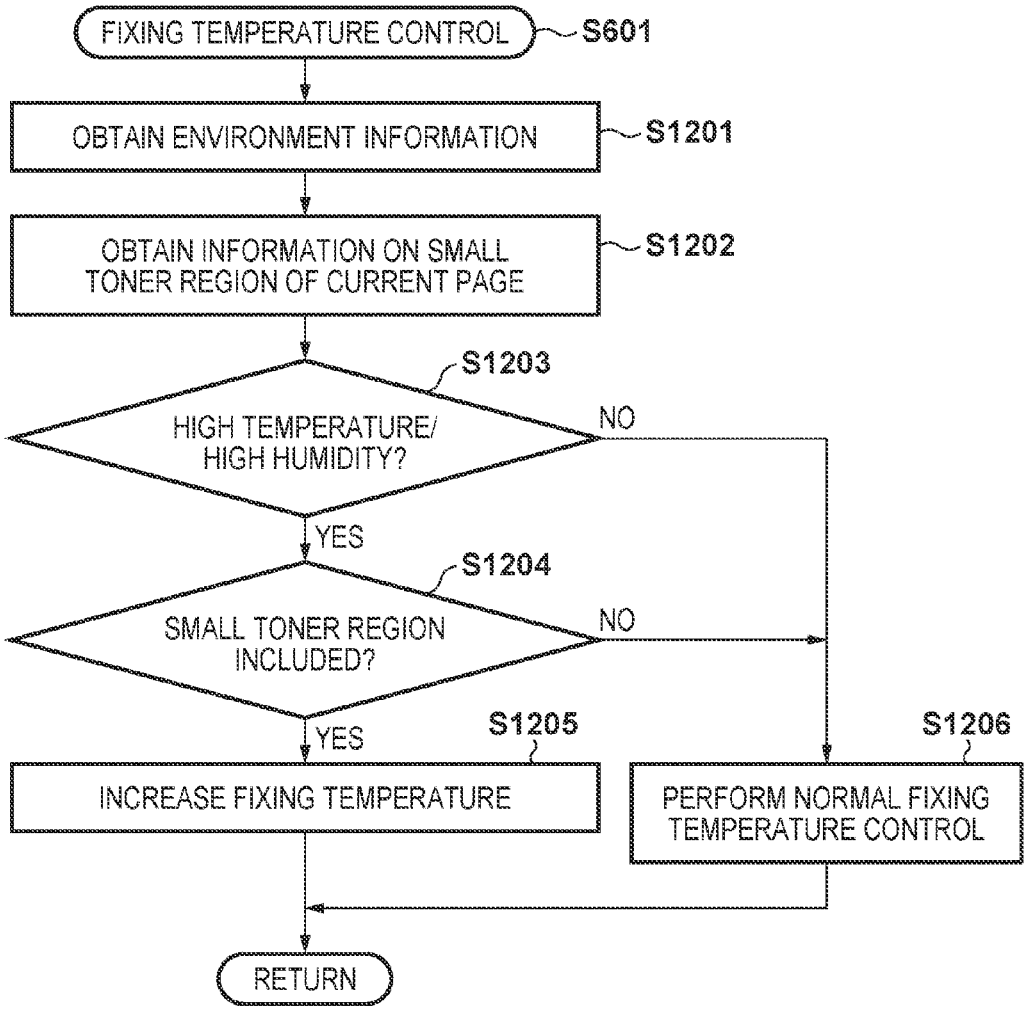
FIG. 12 is a flowchart for describing fixing temperature control in step S601 of FIG. 6 by the image forming apparatus according to the first embodiment.

FIG. 12 is a flowchart for describing the fixing temperature control in step S601 of FIG. 6 by the image forming apparatus according to the first embodiment.

First, in step S1201, the CPU 210 obtains the environment information sensed by the environment sensor 213, or here a temperature and humidity in the environment in which the image forming apparatus 101 is installed. Then, the process advances to step S1202 in which the CPU 210 obtains, from the RAM 212, information indicating whether a current page stored in step S708 described above and to be printed from now includes the small amount of toner applied area having the predetermined area or more. Then, the process advances to step S1203 in which the CPU 210 determines whether or not the environment in which the image forming apparatus 101 is installed is at the high temperature and high humidity. If not so, this temperature control of the fixing unit according to the first embodiment is not performed, and thus the process advances to step S1206 in which normal fixing temperature control is performed, terminating this process.

On the other hand, if the CPU 210 determines, in step S1203, that the environment in which the image forming apparatus 101 is installed is at the high temperature and high humidity, the process advances to step S1204 in which the CPU 210 determines whether to include the small amount of toner applied area having the predetermined area or more, that is, a small toner region. If the CPU 210 determines that the small toner region is not included, the process advances to step S1206; otherwise, the process advances to step S1205. For example, as shown in FIG. 11, the temperature of the fixing unit is controlled to increase by 3° C., terminating this process.

Note that the temperature control of the fixing unit is executed in real time because the fixation of an image on the page basis needs to be increased.

Figure 13:
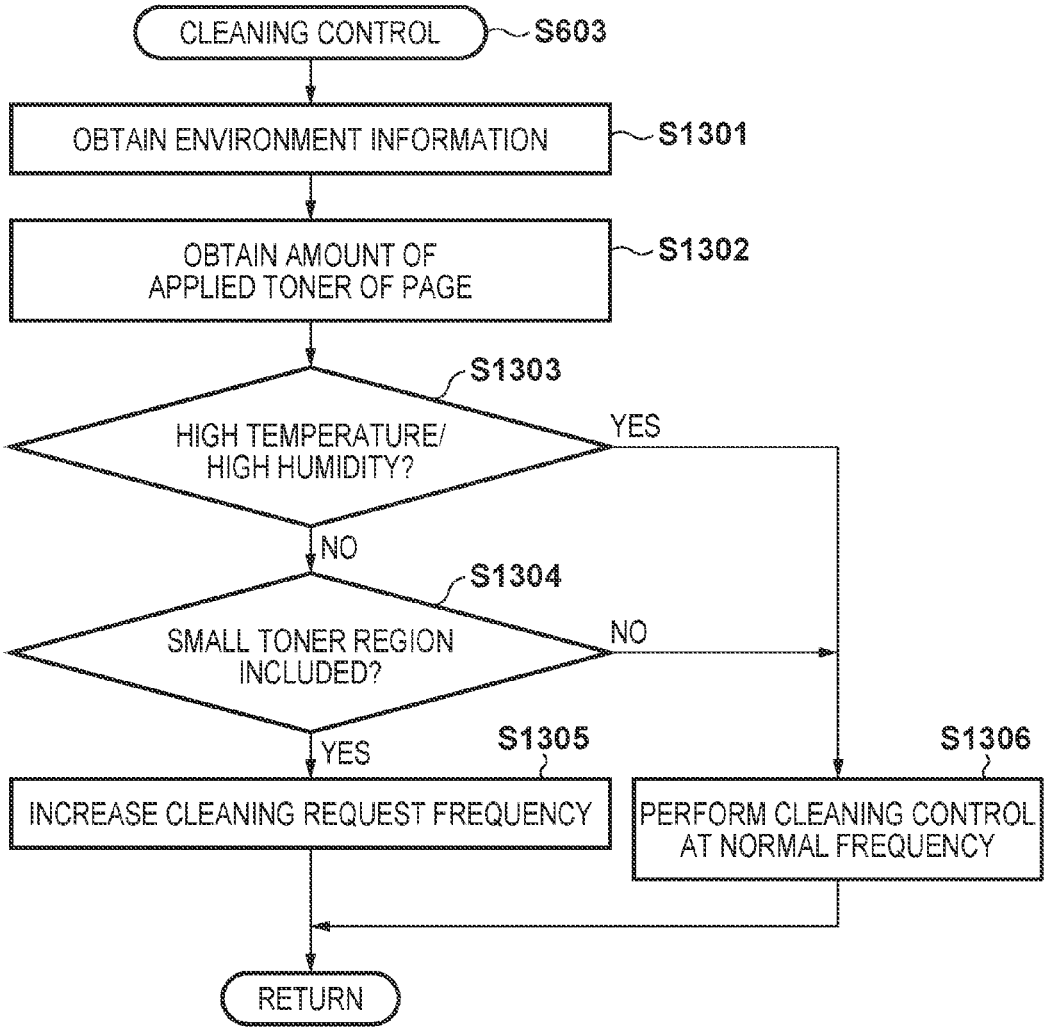
FIG. 13 is a flowchart for describing cleaning control in step S603 of FIG. 6 by the image forming apparatus according to the first embodiment.

FIG. 13 is a flowchart for describing the cleaning control in step S603 of FIG. 6 by the image forming apparatus according to the first embodiment.

First, in step S1301, the CPU 210 obtains the environment information sensed by the environment sensor 213, or here the temperature and humidity in the environment in which the image forming apparatus 101 is installed. Then, the process advances to step S1302 in which the CPU 210 obtains, from the RAM 212, the information indicating whether the current page stored in step S713 described above and to be printed from now includes the small amount of toner applied area having the predetermined area or more. Then, the process advances to step S1303 in which the CPU 210 determines whether or not the environment in which the image forming apparatus 101 is installed is at the high temperature and high humidity. If so, this cleaning control of the fixing unit according to the first embodiment is not performed, and thus the process advances to step S1306 in which normal cleaning control is performed, terminating this process.

On the other hand, if the CPU 210 determines in step S1303 that the environment in which the image forming apparatus 101 is installed is not at the high temperature and high humidity, the process advances to step S1304 in which the CPU 210 determines whether to include the small amount of toner applied area having the predetermined area or more, that is, the small toner region. If the CPU 210 determines that the small toner region is not included, the process advances to step S1306; otherwise, the process advances to step S1305. For example, as shown in FIG. 11, the cleaning request frequency is controlled to increase by 10%, terminating this process.

This control of the cleaning request frequency need not be performed in real time. Susceptibility to dirt by the offset toner is counted as an offset level value. The offset level value is, for example, +1 normally and +1.1 if the frequency is increased by 10%. Then, if the offset level value exceeds a predetermined threshold (for example, 100), the cleaning request is issued for the print unit 206 or the UI unit 205 immediately after one page or immediately after a print job.

As described above, according to the first embodiment, it is possible, by controlling the temperature of the fixing unit for a page including the small amount of toner applied area in which degradation in image quality is conspicuous, to suppress degradation in image to be formed. It is also possible, by increasing the cleaning request frequency for a page including the small amount of toner applied area in which the dirt by the offset toner tends to accumulate in the fixing unit, to maintain good image quality.

Furthermore, according to the first embodiment, it is possible to prevent image degradation by controlling the fixing temperature in accordance with the environment information and the presence/absence of the small amount of toner applied area having the conspicuous poor image quality.

It is also possible to prevent the image degradation by controlling the frequency of the cleaning request of the fixing unit in accordance with the environment information and the presence/absence of the small amount of toner applied area in which the dirt by the offset toner tends to accumulate in the fixing unit.

Second Embodiment

The relationship among an area having the large amount of applied toner (large amount of toner applied area), temperature control of a fixing unit, and a cleaning request frequency will now be described as a second embodiment of the present invention. Note that the arrangement of an image forming apparatus 101 and the arrangement of a system including the image forming apparatus 101 according to the second embodiment are the same as in the first embodiment described above, and thus a description thereof will be omitted.

FIG. 14 depicts a view illustrating an example of a table for explaining the relationship among an amount of applied toner, the temperature control of the fixing unit, and the cleaning request frequency according to the second embodiment.

In FIG. 14, an image analyzing unit 307 determines, in step S702 of FIG. 7, the presence/absence of the large amount of toner applied area with a threshold of the amount of applied toner of 200% or higher. Note that the large amount of toner applied area is under a large influence in image formation, such as making a strong winding of paper around a fixing film when fixation decreases. Therefore, the large amount of toner applied area is detected with a smaller area (for example, 0.2 mm×0.2 mm) than a small amount of toner applied area.

In accordance with the setting of the high-saturation print mode in the item list 502 of FIG. 5, the fixing temperature control and the cleaning request frequency in a case in which the large amount of toner applied area and the small amount of toner applied area are mixed including a case in which the maximum amount of applied toner in the large amount of toner applied area is switched between 200% and 230% are shown. For example, in a high-saturation print mode in a high-temperature/high-humidity environment of 230% denoted by reference numeral 1401, a further heat amount for melting toner is needed in order to increase a toner amount in the large amount of toner applied area than usual. Therefore, the temperature of the fixing unit is increased by 5° C. than usual.

In a page where the large amount of toner applied area and the small amount of toner applied area are mixed, a condition having a higher temperature is given priority. Therefore, in a page where the high-saturation print mode (230%) and a small amount of applied toner (50% (large area)) are mixed in the high-temperature/high-humidity environment denoted by reference numeral 1402, a temperature needed is increased by 5° C. than usual in the small amount of toner applied area. Consequently, the heat amount is not lacking but becomes excessive in the small amount of toner applied area, increasing the cleaning request frequency by 5%.

Figure 16:
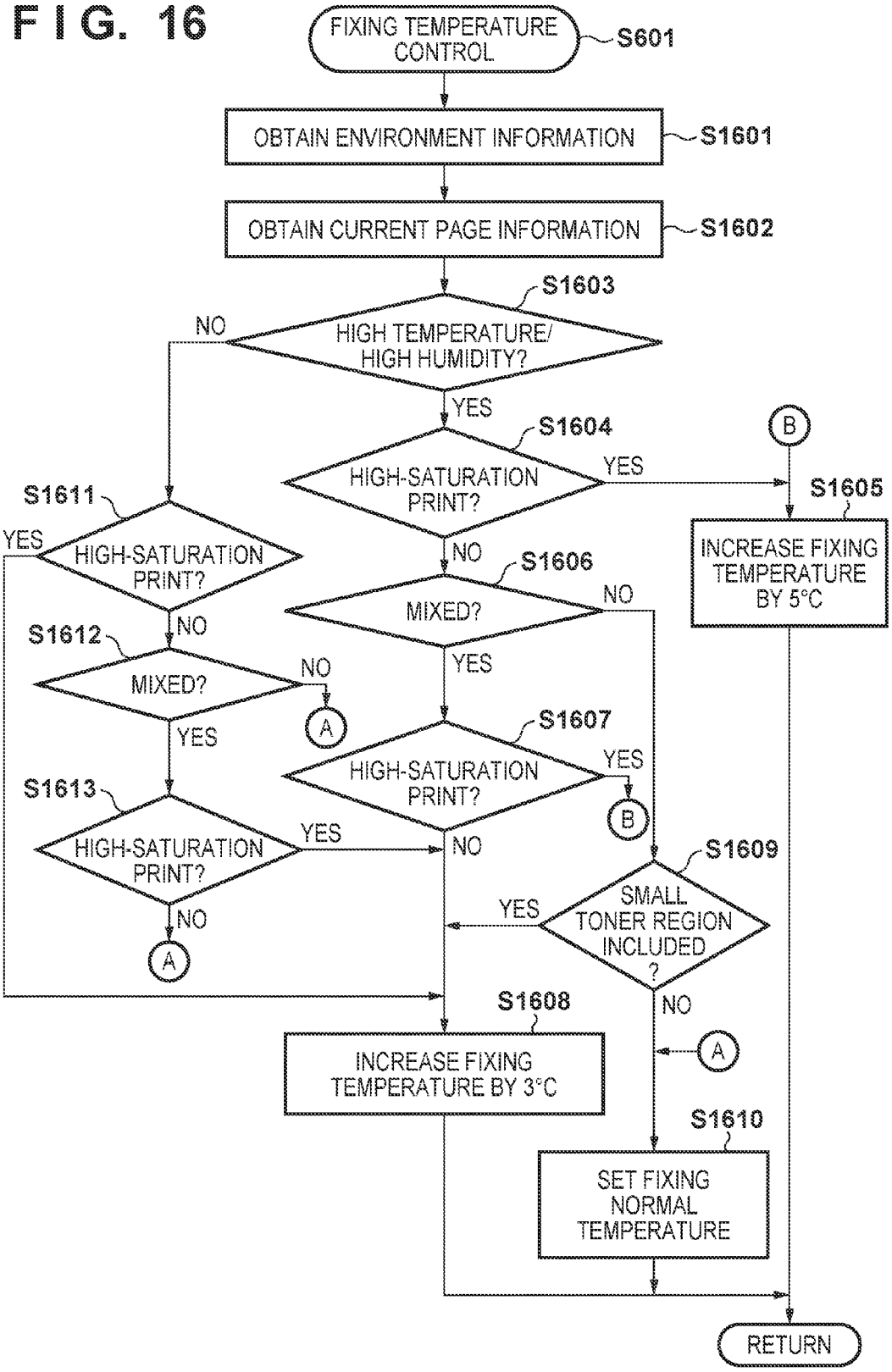
FIG. 16 is a flowchart for describing fixing temperature control in step S601 of FIG. 6 by an image forming apparatus according to the second embodiment.

FIG. 16 is a flowchart for describing the fixing temperature control in step S601 of FIG. 6 by the image forming apparatus 101 according to the second embodiment.

First, in step S1601, a CPU 210 obtains environment information sensed by an environment sensor 213, or here a temperature and humidity in an environment in which the image forming apparatus 101 is installed. Then, the process advances to step S1602 in which the CPU 210 obtains, from a RAM 212, information indicating whether a current page stored in step S713 described above and to be printed from now includes the small amount of toner applied area having a predetermined area or more and the high-saturation print mode. Then, the process advances to step S1603 in which the CPU 210 determines whether or not the environment in which the image forming apparatus 101 is installed is at the high temperature and high humidity. If so, the process advances to step S1604; otherwise, the process advances to step S1611. In step S1604, the CPU 210 determines whether or not the high-saturation print mode is set. If the high-saturation print mode is set, the process advances to step S1605 in which the temperature of the fixing unit is increased by 5° C., terminating this process. If the high-saturation print mode is not set in step S1604, the process advances to step S1606 in which the CPU 210 determines whether or not the small amount of toner applied area and the large amount of toner applied area are mixed. If the CPU 210 determines here that they are mixed, the process advances to step S1607 in which the CPU 210 determines whether this mixing includes the high-saturation print mode. If the mixing includes the high-saturation print mode, the process advances to step S1605; otherwise, the process advances to step S1608 in which the temperature of the fixing unit is increased by 3° C., terminating this process. If the CPU 210 determines in step S1606 that they are not mixed, the process advances to step S1609 in which the CPU 210 determines whether this page includes the small amount of toner applied area. If this page includes the small amount of toner applied area, the process advances to step S1608 in which the temperature of the fixing unit is increased by 3° C.; otherwise, the process advances to step S1610 in which the normal temperature of the fixing unit is set, terminating this process.

If the CPU 210 determines in step S1603 that the environment in which the image forming apparatus 101 is installed is not at the high temperature and high humidity, the process advances to step S1611 in which the CPU 210 determines whether or not the high-saturation print mode is set. If the CPU 210 determines in step S1611 that the high-saturation print mode is set, the process advances to step S1608 in which the temperature of the fixing unit is increased by 3° C.; otherwise, the process advances to step S1612. In step S1612, the CPU 210 determines whether or not the small amount of toner applied area and the large amount of toner applied area are mixed. If the CPU 210 determines here that they are not mixed, the process advances to step S1610 in which the temperature of the fixing unit is set normally. If they are mixed, the process advances to step S1613 in which the CPU 210 determines whether or not the high-saturation print mode is set. If the CPU 210 determines here that the high-saturation print mode is set, the process advances to step S1608 in which the temperature of the fixing unit is increased by 3° C.; otherwise, the process advances to step S1610 in which the temperature of the fixing unit is set normally, terminating this process.

Figure 17:
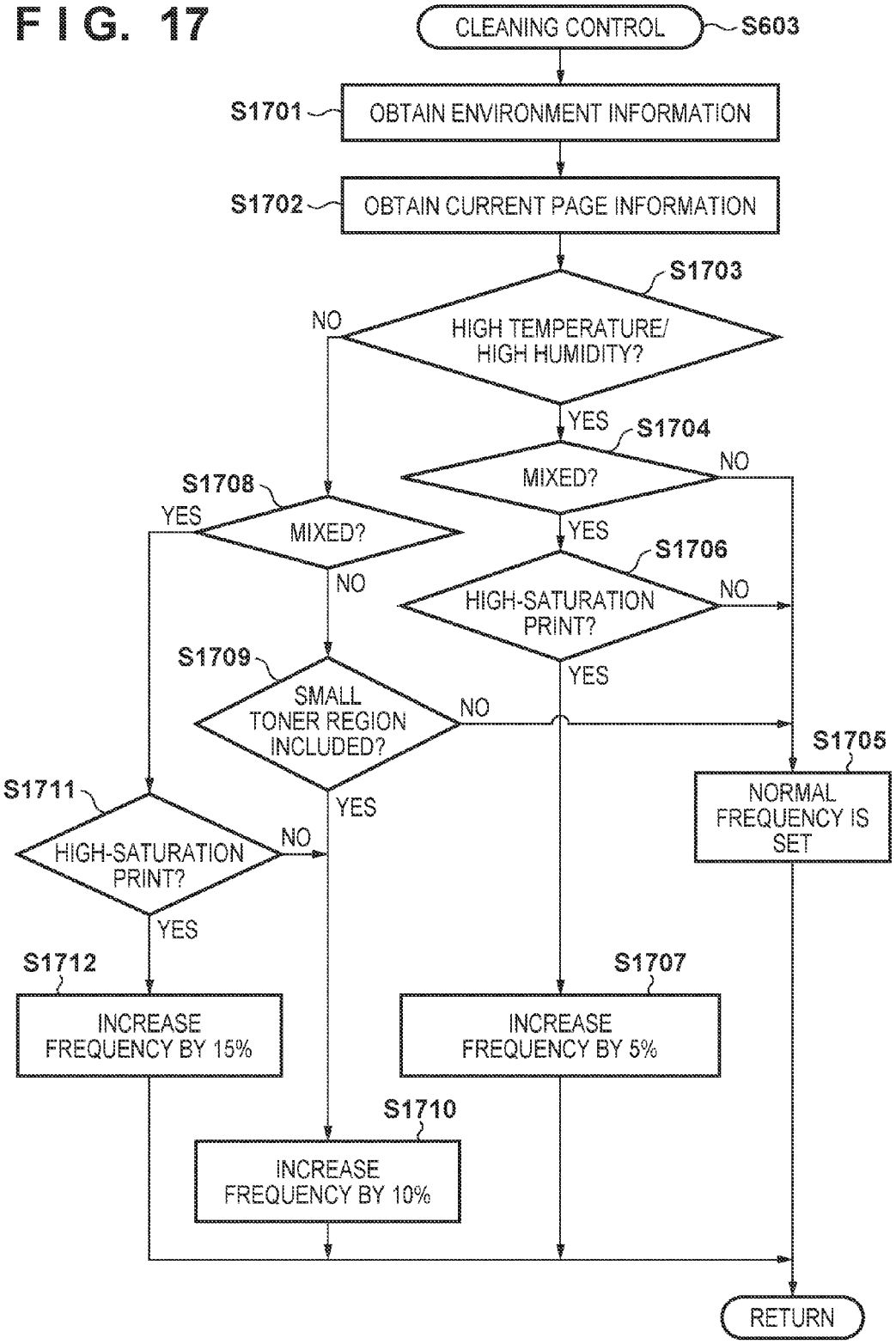
FIG. 17 is a flowchart for describing cleaning control in step S603 of FIG. 6 by the image forming apparatus according to the second embodiment.

FIG. 17 is a flowchart for describing the cleaning control in step S603 of FIG. 6 by the image forming apparatus according to the second embodiment.

First, in step S1701, the CPU 210 obtains the environment information sensed by the environment sensor 213, or here the temperature and humidity in the environment in which the image forming apparatus 101 is installed. Then, the process advances to step S1702 in which the CPU 210 obtains, from the RAM 212, the information indicating whether the current page stored in step S713 described above and to be printed from now includes the small amount of toner applied area having the predetermined area or more and the high-saturation print mode. Then, the process advances to step S1703 in which the CPU 210 determines whether or not the environment in which the image forming apparatus 101 is installed is at the high temperature and high humidity. If so, the process advances to step S1704; otherwise, the process advances to step S1708. In step S1704, the CPU 210 determines whether or not the small amount of toner applied area and the large amount of toner applied area are mixed in the current page. If the CPU 210 determines here that they are not mixed, the process advances to step S1705 in which a cleaning frequency is set to a normal frequency, terminating this process.

On the other hand, if the CPU 210 determines in step S1704 that the small amount of toner applied area and the large amount of toner applied area are mixed, the process advances to step S1706 in which the CPU 210 determines whether or not the high-saturation print mode is set. If the high-saturation print mode is set, the process advances to step S1707. In step S1707, the CPU 210 increases the cleaning frequency by 5%, terminating this process. On the other hand, when the high-saturation print mode is not set in step S1704, the process advances to step S1705 in which the cleaning frequency is set normally, terminating this process.

If the CPU 210 determines in step S1703 that the environment in which the image forming apparatus 101 is installed is not at the high temperature and high humidity, the process advances to step S1708 in which the CPU 210 determines whether or not the small amount of toner applied area and the large amount of toner applied area are mixed. If the CPU 210 determines here that they are mixed, the process advances to step S1711 in which the CPU 210 determines whether or not the high-saturation print mode is set. If the CPU 210 determines in step S1711 that the high-saturation print mode is set, the process advances to step S1712 in which the cleaning frequency is increased by 15%; otherwise, the process advances to step S1710 in which the cleaning frequency is increased by 10%, terminating this process.

If the CPU 210 determines in step S1708 that the small amount of toner applied area and the large amount of toner applied area are not mixed, the process advances to step S1709. In step S1709, the CPU 210 determines whether or not there is the small amount of toner applied area having the predetermined area or more. If the CPU 210 determines so, the process advances to step S1710 in which the cleaning frequency is increased by 10%, terminating this process. On the other hand, if the CPU 210 determines that there is not the small amount of toner applied area, the process advances to step S1705 in which the cleaning frequency is set to the normal frequency, terminating this process.

Note that the value of the temperature to be increased, the cleaning frequency, and the like described above in the second embodiment are not limited to numeric values described above.

As described above, according to the second embodiment, there is an effect that degradation in an image to be formed can be prevented by performing the cleaning control and temperature control of the fixing unit appropriately even if the small amount of toner applied area and the large amount of toner applied area are mixed in an image of one page.

Third Embodiment

As the third embodiment of the present invention, an example will now be described in which a region where a small amount of applied toner is continuously obtained a plurality of times at the same main scanning position of a fixing unit (fixing roller/fixing film) and a sub-scanning position thereof is detected, and it is detected whether its area is equal to or larger than a predetermined value. Note that the arrangement of an image forming apparatus 101 and the arrangement of a system including the image forming apparatus 101 according to the third embodiment are the same as in the first embodiment described above, and thus a description thereof will be omitted.

If a toner image having a small amount of applied toner is fixed continuously a plurality of times at the same position of the fixing unit (fixing roller/fixing film), occurrence of a variation in a heat amount is concentrated on the position, decreasing fixation more noticeably. For example, if A4 (210×297 mm) paper and a fixing roller having a boundary length of 60 mm are used, fixing is performed by utilizing the same position of the fixing roller five times (from 297/60=4.45) while one page is printed on the paper.

Therefore, in the third embodiment, the position of a local region on a sheet that is a small amount of applied toner generated while printing one page is mapped to the coordinate system of a roller of the fixing unit (fixing unit coordinates), and the number of continuous generation of the small amount of applied toner at each main scanning position and the sub-scanning position thereof at the fixing unit coordinates is counted. An area having a continuous small amount of toner applied region is measured at a small-amount-of-applied-toner repetition position where the maximum value of this number exceeds a predetermined number (here, 2). Note that a method of measuring the area will be described by basically using the same method as in the first embodiment. However, the present invention is not limited to this.

First, in measuring the area, a maximum value including a continuous place where the small amount of applied toner is obtained in a sub-scanning direction at each main scanning position of the fixing unit coordinates is obtained, and an area where the maximum value exceeds a predetermined value (here, 10 mm) is detected. Then, a maximum value with an area having a continuous quantity in the sub-scanning direction equal to or larger than a predetermined value continuous in a main scanning direction is obtained, and it is judged whether it exceeds a predetermined value (here, 10 mm). Then, when a page having an area with an area in which the small amount of applied toner is continuously obtained the plurality of times at the fixing unit coordinates exceeding 10×10 mm is detected, temperature control (step S601) of a fixing unit at the time of fixing the page is performed.

Figure 18A:
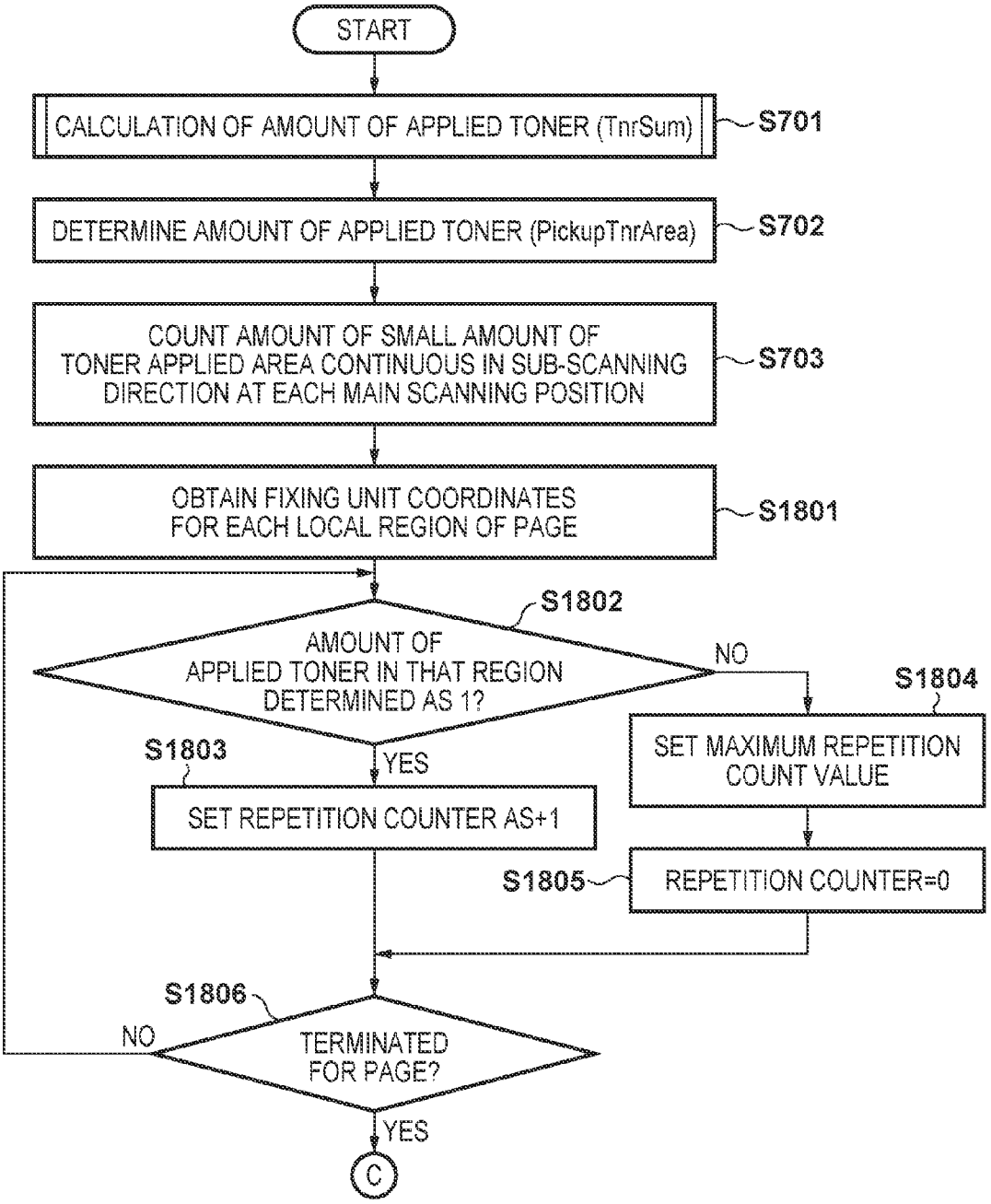
FIGS. 18A and 18B are flowcharts for describing image analysis processing by an image analyzing unit of an image forming apparatus according to a third embodiment.
Figure 18B:
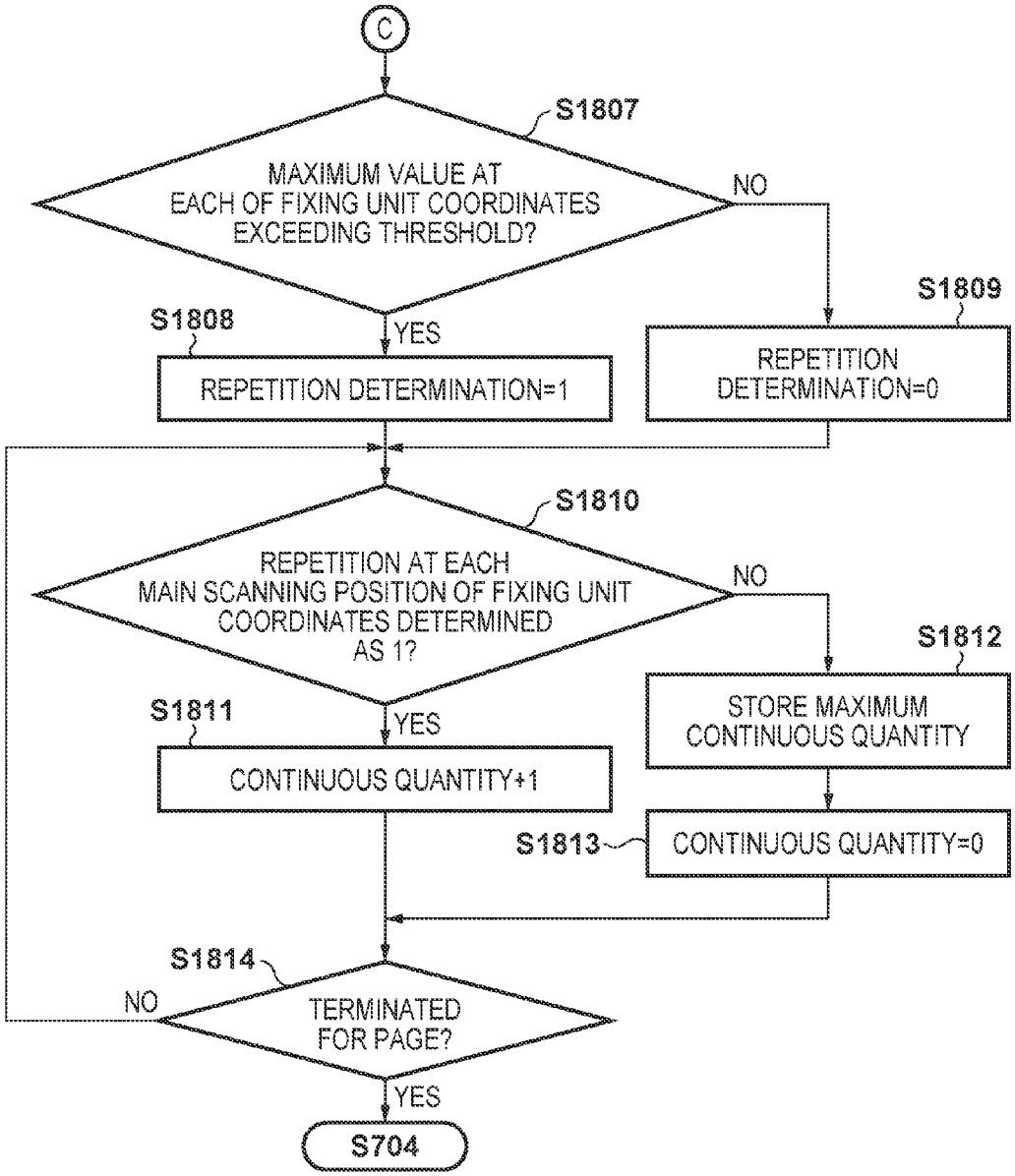

FIGS. 18A and 18B are flowcharts for describing image analysis processing by an image analyzing unit 307 of the image forming apparatus 101 according to the third embodiment. As an example here, assuming that an area having 10% to about 70% of an amount of applied toner in a local region is a small amount of toner applied area, an area (10 mm×10 mm) where the small amount of applied toner is repeated twice or more at the same position of the fixing unit coordinates is detected. Note that here, a description will be given assuming that the processing shown in this flowchart is performed by causing a CPU 210 to deploy programs stored in a storage unit 204 to a RAM 212 and execute the deployed programs. Note that in FIGS. 18A and 18B, the same reference numerals denote the same processing as in FIG. 7 described above.

First, in step S701, the CPU 210 analyzes the CMYK data after the image forming processing received in step S405 of FIG. 4 and calculates an amount of applied toner (TnrSum) for each local region. Then, the process advances to step S702 in which the CPU 210 determines whether or not the amount of applied toner (TnrSum) in the local region calculated in step S701 falls within a threshold range designated in advance. If the CPU 210 determines here that the amount of applied toner (TnrSum) falls within the threshold range, PickupTnrArea=1 is set. If the CPU 210 determines that the amount of applied toner (TnrSum) does not fall within the threshold range, PickupTnrArea=0 is set. Note that here, 10%<TnrSum<70% is set as an example of the threshold range. However, the present invention is not limited to this. Then, the process advances to step S703 in which the CPU 210 counts, at a main scanning position N, a quantity yRun (main scanning position) of lines with the local region of PickupTnrArea=1 continuous in the sub-scanning direction.

Then, the process advances to step S1801 in which the CPU 210 calculates fixing unit coordinates (fpx, fpy) corresponding to respective local regions in the page. Note that a size having conspicuous poor image quality in the small amount of toner applied area is a large size exceeding an mm-size, and thus the fixing unit coordinates may be obtained for the amount of applied toner in the local region sampled roughly such as on the 100 dpi-basis. For example, if both local region coordinates (kpx, kpy) and the fixing unit coordinates (fpx, fpy) are at 100 dpi, fpx=kpx fpy=kpy % (the boundary length of the roller of the fixing unit)

are obtained. In these equations, % means a remainder. The fixing unit coordinates indicate coordinates on the fixing roller/fixing film. The boundary length of the fixing roller is 60 mm (about 236 pix if converted into 100 dpi) as an example here.

Then, the process advances to step S1802 in which the CPU 210 determines whether or not a position indicated by the fixing unit coordinates (fpx, fpy) obtained in step S1801 has the small amount of applied toner (PickupTnrArea=1) depending on whether PickupTnrArea of a local region in a page corresponding to the fixing unit coordinates is "1". If the position indicated by the fixing unit coordinates has the small amount of applied toner, the process advances to step S1803 in which the CPU 210 sets a repetition counter FuserPosRepeat[fpx][fpy] as +1, advancing to step S1806. On the other hand, when PickupTnrArea of the local region in the page corresponding to the fixing unit coordinates is "0", the CPU 210 judges that the continuity of the small amount of applied toner is broken, and the process advances to step S1804 in which the value of the repetition counter at that time is recorded in a repetition maximum value FuserPosRepeatMax[fpx][fpy]. More specifically, the repetition maximum value FuserPosRepeatMax[fpx][fpy] and the repetition counter FuserPosRepeat[fpx][fpy] are compared, and the repetition maximum value FuserPosRepeatMax[fpx][fpy] is updated with a larger value. Then, the repetition counter is cleared in step S1805 because the continuity of the small amount of applied toner is broken, and the process advances to step S1806. In step S1806, the CPU 210 determines whether or not processing for the page is terminated. If it is terminated, the process advances to step S1807; otherwise, the process returns to step S1802. The value of the repetition maximum value FuserPosRepeatMax[fpx][fpy] in each of the fixing unit coordinates is thus obtained for each page to be printed.

In step S1807, the CPU 210 determines whether or not the repetition maximum value at each of the fixing unit coordinates exceeds a threshold (repeatThre (here, 2)) designated in advance. If it exceeds the threshold, the process advances to step S1808 in which a repetition determination FuserPosRepeatThreOver[fpx][fpy]=1 is set, advancing to step S1810. On the other hand, if it is equal to or smaller than the threshold, the process advances to step S1809 in which the repetition determination FuserPosRepeatThreOver[fpx][fpy]=0 is set, advancing to step S1810. Note that the threshold (repeatThre) is "2" here. However, the present invention is not limited to this. A value may be changed in accordance with a condition on which fixing performance such as an engine speed or an ambient state changes. Consequently, a result of the repetition determination at each of the fixing unit coordinates is obtained.

In step S1810, the CPU 210 determines whether or not a repetition determination FuserPosRepeatThreOver[fpx][ ]=1 is set at each main scanning position of the fixing unit coordinates. If so, the process advances to step S1811 in which a continuous quantity yRun[fpx] continuous in the sub-scanning direction is set as +1, advancing to step S1814. Unlike the first embodiment, not the judgment result of the amount of applied toner in the local region in the page but a continuous quantity, in the sub-scanning direction, of a repetition area of the fixing unit coordinates in each main scanning direction is obtained. The roller and the film of the fixing unit rotate, and thus the same coordinates are referred periodically and repeatedly in the sub-scanning direction. Therefore, if continuity is not broken at a lower end fpy=235 (the boundary length of the fixing unit−1 pix), the possibility of the continuity going around an upper end fpy=0 needs to be considered. Therefore, if FuserPosRepeatThreOver[fpx][ ]=1 is set, the CPU 210 judges that the small amount of toner applied area is continuous in the sub-scanning direction and sets the continuous quantity yRun[fpx] as +1.

Note that in a case of FuserPosRepeatThreOver[fpx][0]=1 with the small amount of toner applied area being generated from the upper end, the continuous quantity is stored in yRunUpperObj[fpx] when the continuity is broken first. Then, in a case of FuserPosRepeatThreOver[fpx][235]=1 with the small amount of applied toner obtained at the lower end, coupling is made with the continuous quantity at the upper end, and an update is performed with the continuous quantity yRun[fpx]=yRun[fpx]+1+yRunUpperObj[fpx].

On the other hand, if FuserPosRepeatThreOver[fpx][ ]=0 is obtained in the repetition determination in step S1810, the CPU 210 judges that the continuity in the sub-scanning direction is broken, and the process advances to step S1812. In step S1812, the CPU 210 records a maximum continuous quantity yRunMax[fpx] of sub-scanning continuity. More specifically, the maximum continuous quantity yRunMax[fpx] and the continuous quantity yRun[fpx] at that time are compared, and the maximum continuous quantity yRunMax[fpx] is updated with a larger value. Then, the continuous quantity yRun[fpx]=0 is set in step S1813, and the process advances to step S1814. Consequently, it is determined in step S1814 whether or not the processing is performed for one page. If the processing is not performed for one page, the process returns to step S1810. If the processing for one page is terminated, the process advances to step S704 (FIG. 7).

Then, as in the first embodiment, the processes in steps S704 to S709 of FIG. 7 are performed, calculating the area of an area continuously obtaining the small amount of applied toner a plurality of times in the sub-scanning direction at each main scanning position at the fixing unit coordinates. In step S709, based on a result detected in the above-described processing, the CPU 210 stores, in the RAM 212, the fact that the page includes the small amount of toner applied area having an area equal to or more than a predetermined value, terminating this processing. Then, if the area exceeds, for example, 10×10 mm, fixing temperature control and cleaning control are performed as a page where fixation decreases noticeably.

Figure 19:
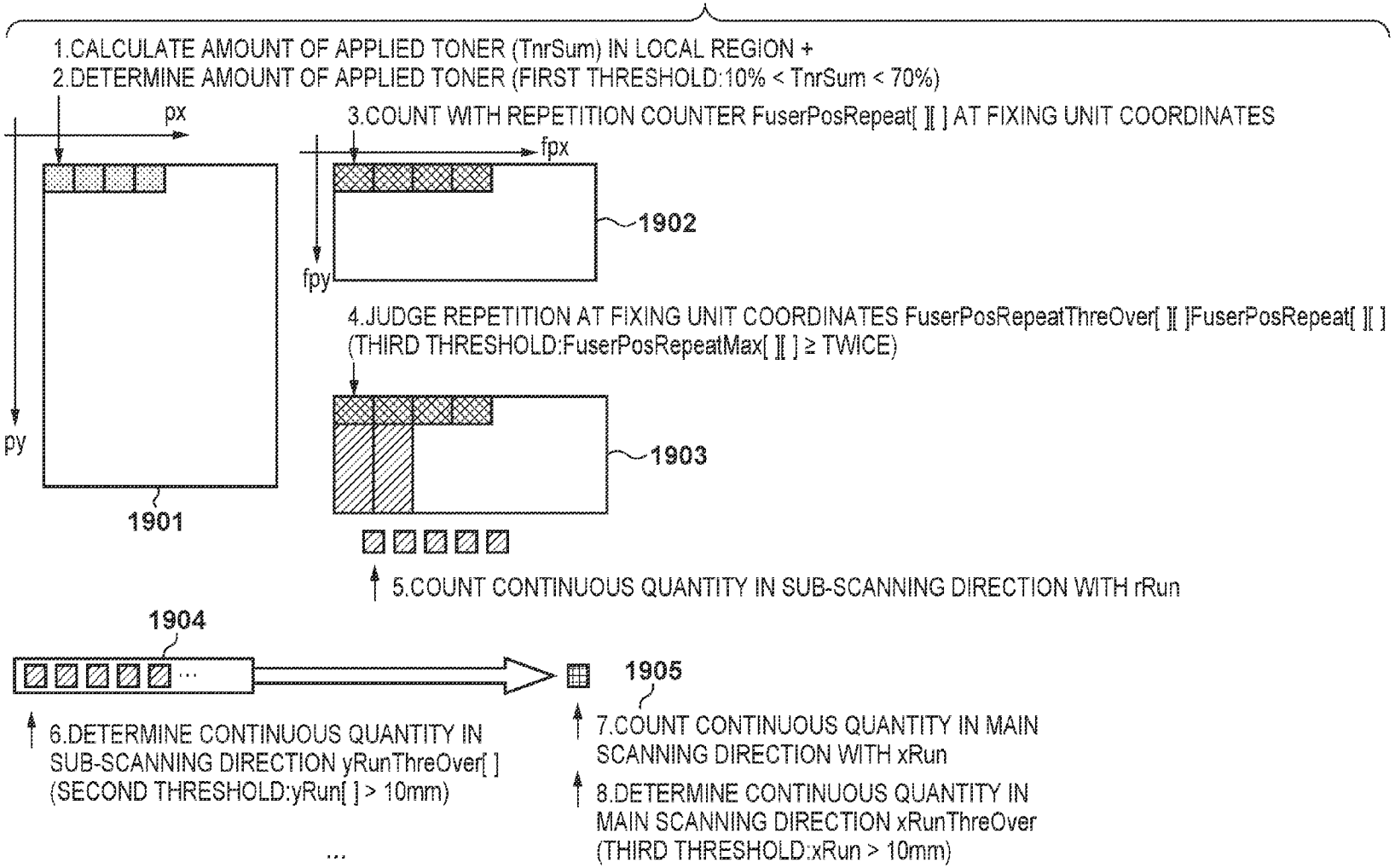
FIG. 19 depicts a view for explaining the overview of a process for obtaining a small amount of toner applied region in accordance with the flowchart of FIGS. 18A and 18B according to the third embodiment.

FIG. 19 depicts a view for explaining the overview of a process for obtaining the small amount of toner applied region in accordance with the flowchart of FIGS. 18A and 18B according to the third embodiment.

In FIG. 19, reference numeral 1901 denotes a small amount of toner applied region in the page, and reference numeral 1902 denotes an object obtained by mapping it as the small amount of toner applied area at the fixing unit coordinates. Reference numeral 1903 denotes a process of detecting an area in which the small amount of toner applied area is continuous by a predetermined amount in the sub-scanning direction at each main scanning position of the fixing unit coordinates. Reference numeral 1904 denotes an example in which an area where the small amount of toner applied area is continuous by 10 mm or more in the sub-scanning direction at each main scanning position of the fixing unit coordinates is detected. Further, reference numeral 1905 denotes an example in which a region in which the small amount of toner applied area is continuous by 10 mm or more in the sub-scanning direction detects an area continuous by 10 mm or more in the main scanning direction.

Note that in FIGS. 18A and 18B, the repetition determination is made after the repetition amount of the fixing unit coordinates corresponding to print data for one page is counted, and an area having the small amount of toner applied area continuous in the main scanning and sub-scanning directions is obtained. However, the present invention is not limited to this.

Figure 20:
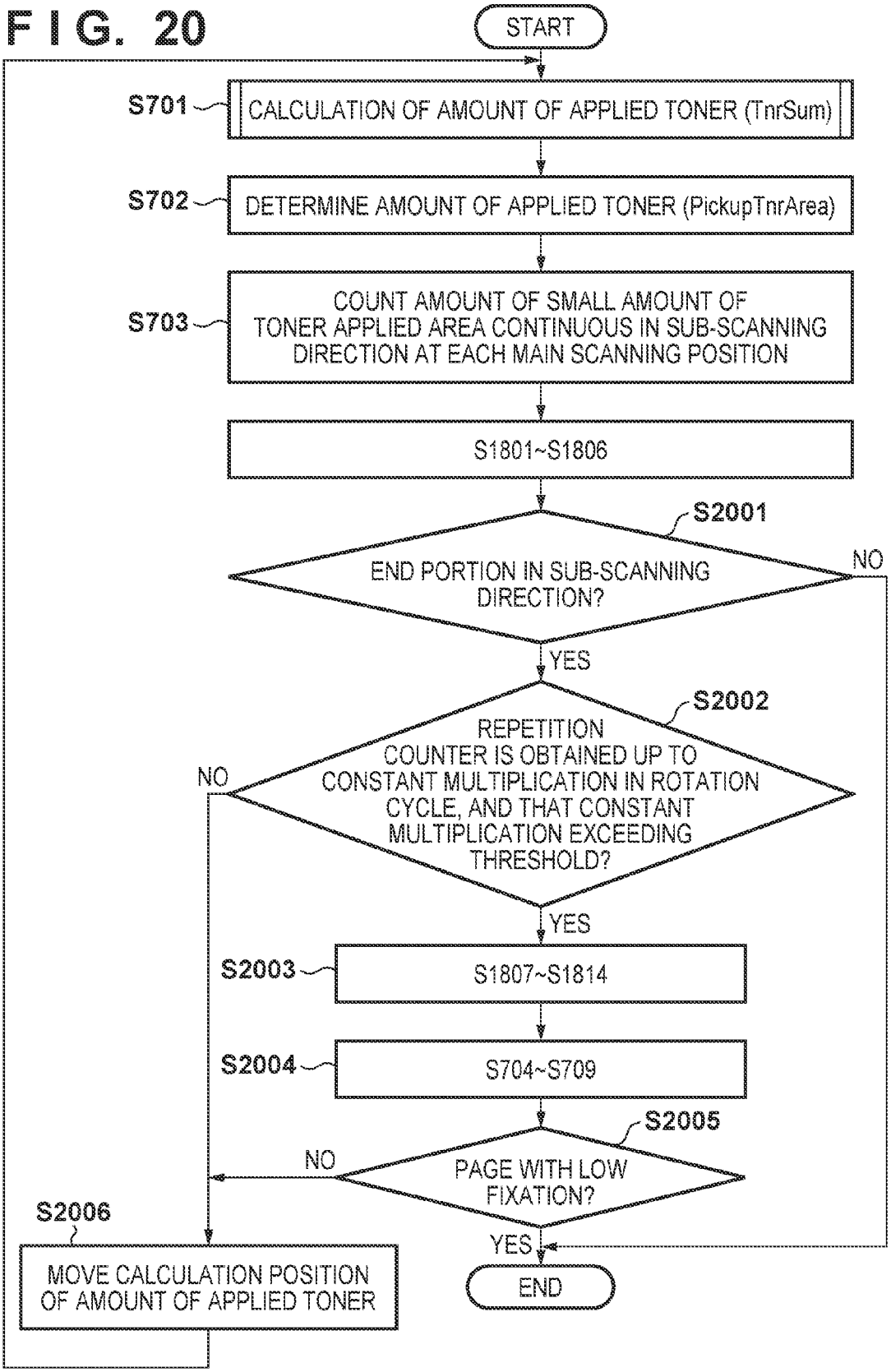
FIG. 20 is a flowchart for describing a modification of the image analysis processing in FIGS. 18A and 18B by the image analyzing unit of the image forming apparatus according to the third embodiment.

FIG. 20 is a flowchart for describing a modification of the image analysis processing in FIGS. 18A and 18B by the image analyzing unit 307 of the image forming apparatus 101 according to the third embodiment. Note that the same reference numerals denote steps common to those in FIGS. 18A and 18B, and a description thereof will be omitted.

If an end portion in the sub-scanning direction is determined in step S2001, the process advances to step S2002 in which the CPU 210 determines whether or not calculation of the amount of applied toner and the repetition count of the fixing unit coordinates are executed up to a constant multiplication position in a rotation cycle of the fixing unit, and additionally determines whether or not that constant multiplication exceeds the threshold (repeatThre=2). If its determination result is Yes here, the process advances to step S2003. The processes in steps S1807 to S1814 described in FIGS. 18A and 18B and the processes in steps S704 to S709 of FIG. 7 are performed in steps S2003 and S2004, respectively, obtaining the area having the continuous small amount of toner applied area in the main scanning and sub-scanning directions. Then, in step S2005, the CPU 210 determines whether or not a small amount of toner applied area having an area of 10×10 mm has existed already in N rounds (N is equal to or larger than repeatThre and equal to or larger than 2) of the fixing unit. Then, if the CPU 210 determines that the fixation of the page is low because there exists the small amount of toner applied area having the area of 10×10 mm, this processing ends; otherwise, the process advances to step S2006 in which a calculation position of the amount of applied toner is moved. Then, the process advances to step S701 to perform the aforementioned process.

This makes it possible, for example, in a case of a page with the small amount of toner applied area of 10×10 mm presents on the side of a page front end, to determine quickly that the page is low in fixation.

As described above, according to the third embodiment, it is possible to sense the page where the small amount of toner applied area is fixed repeatedly at the same position of the fixing unit (fixing roller/fixing film), causing a concentrated variation in the heat amount. This makes it possible to perform the fixing temperature control and the cleaning control on such a page.

Fourth Embodiment

In the third embodiment described above, the area of the small amount of toner applied area at the fixing unit coordinates is detected. However, a mechanism is high in cost in such a manner that it is necessary to include the repetition counter for the boundary length of fixing unit members (fixing roller/fixing film).

If, in the method of the first embodiment described above, an area of a small amount of toner applied area is set in consideration of the boundary length of a fixing unit (fixing roller/fixing film), an extremely large area is designated. In addition, detection omission is also made. For example, if the boundary length of the fixing unit (fixing roller/fixing film) is 60 mm, an area of 10×70 mm needs to be detected in the method of the first embodiment described above in order to detect a page where 10×10 mm is repeated at the same position for two cycles. Moreover, the area can be detected when the small amount of toner applied area is continuous by 10×70 mm but it cannot be detected when, for example, the small amount of toner applied region of 10×10 mm is divided into a plurality of regions, and a small amount of toner applied regions exist at the same position for two cycles as in FIG. 21.

Therefore, in the fourth embodiment, if a gap area from a start object of the small amount of toner applied area to a next small amount of toner applied area has a predetermined size or less, these two small amount of toner applied areas are regarded as a combined small amount of toner applied region, and an area thereof is obtained. This makes it possible to determine whether the same position of fixing unit coordinates is in a page where the small amount of toner applied areas are fixed continuously even if the small amount of toner applied area exists with being divided into a plurality of areas in a sub-scanning direction. Note that the arrangement of an image forming apparatus 101 and the arrangement of a system including the image forming apparatus 101 according to the fourth embodiment are the same as in the first embodiment described above, and thus a description thereof will be omitted.

Figure 22:
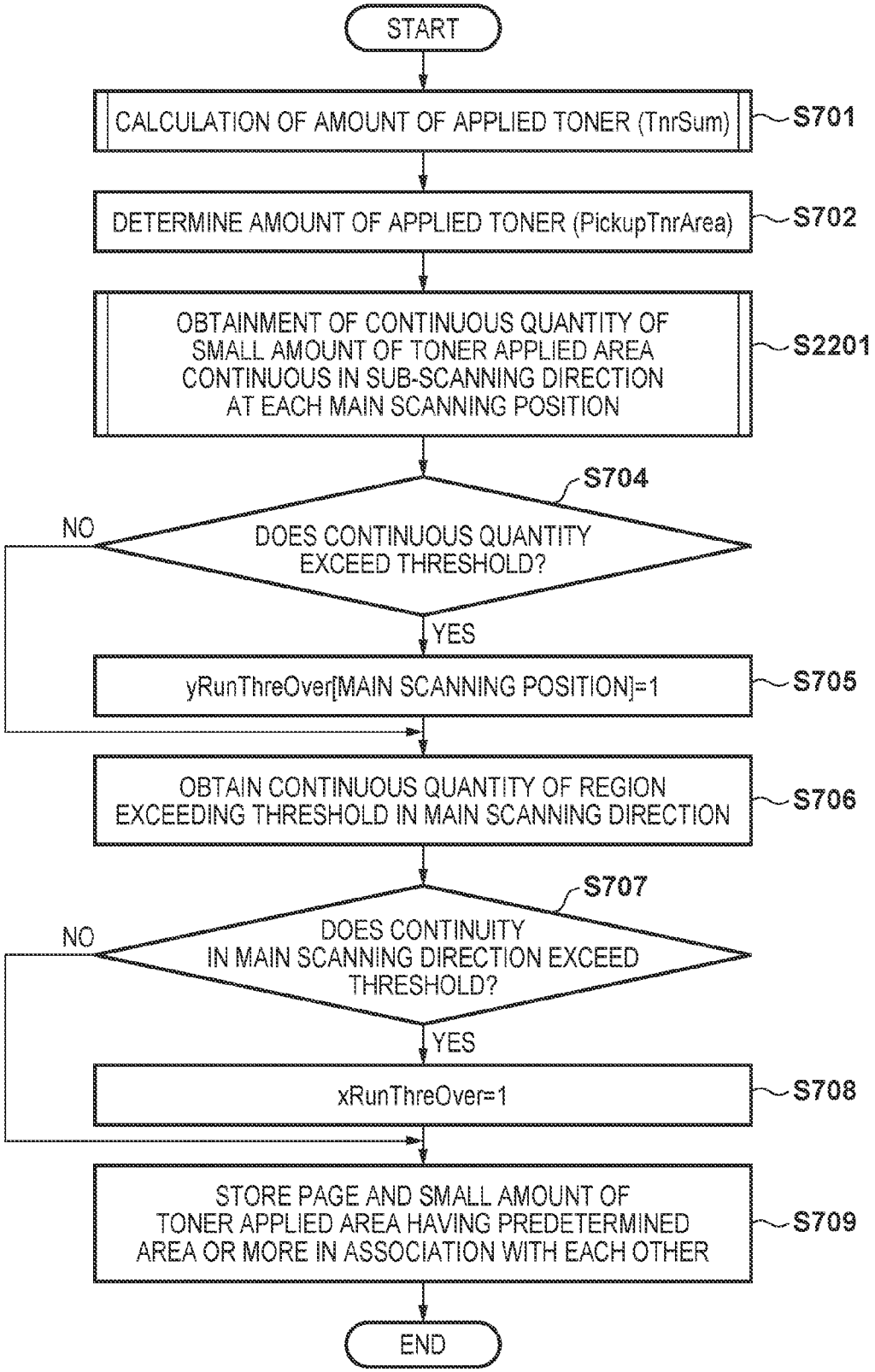
FIG. 22 is a flowchart for describing image analysis processing by an image analyzing unit of an image forming apparatus according to a fourth embodiment.

FIG. 22 is a flowchart for describing image analysis processing by an image analyzing unit 307 of the image forming apparatus 101 according to the fourth embodiment. Note that here, a description will be given assuming that the processing shown in this flowchart is performed by causing a CPU 210 to deploy programs stored in a storage unit 204 to a RAM 212 and execute the deployed programs.

As an example here, assuming that an area having 10% to about 70% of a local amount of applied toner is the small amount of toner applied area, a roller of the fixing unit having a boundary length of 60 mm and an area having a small amount of applied toner of 10×70 mm (allowing a gap of 50 mm) are detected. Consequently, an area having a small amount of applied toner of 10×10 mm divided into a plurality of areas continuous in two cycles is detected, as in FIG. 21.

First, in step S701, the CPU 210 analyzes the CMYK data after the image forming processing received by the image analyzing unit 307 and calculates an amount of applied toner (TnrSum) for each local region. Then, the process advances to step S702 in which the CPU 210 determines whether or not the calculated amount of applied toner in a local region falls within a threshold range designated in advance. If it falls within the threshold range, PickupTnrArea=1 is set. If it does not fall within the threshold range, PickupTnrArea=0 is set. Note that here, 10%<TnrSum<70% is set as an example of the threshold range. However, the present invention is not limited to this.

Then, the process advances to step S2201 in which the CPU 210 obtains a continuous quantity yRun [main scanning position] with a location region of PickupTnrArea=1 continuous in the sub-scanning direction at each main scanning position. Unlike the first embodiment, in this fourth embodiment, if a condition matches a specific condition, an area without the small amount of applied toner is treated as a gap, and a count is made assuming that a small amount of toner applied region is continuous in the sub-scanning direction including that gap. A detail thereof will be described later with reference to a flowchart of FIG. 23.

Then, as in the first embodiment, steps S704 to S709 are performed to calculate the area of the small amount of toner applied area fixed repeatedly by the fixing unit. Then, if the area exceeds, for example, 10×70 mm, it is determined that fixation decreases in a page, and fixing temperature control and cleaning control are performed in image formation of the page.

Figure 23:
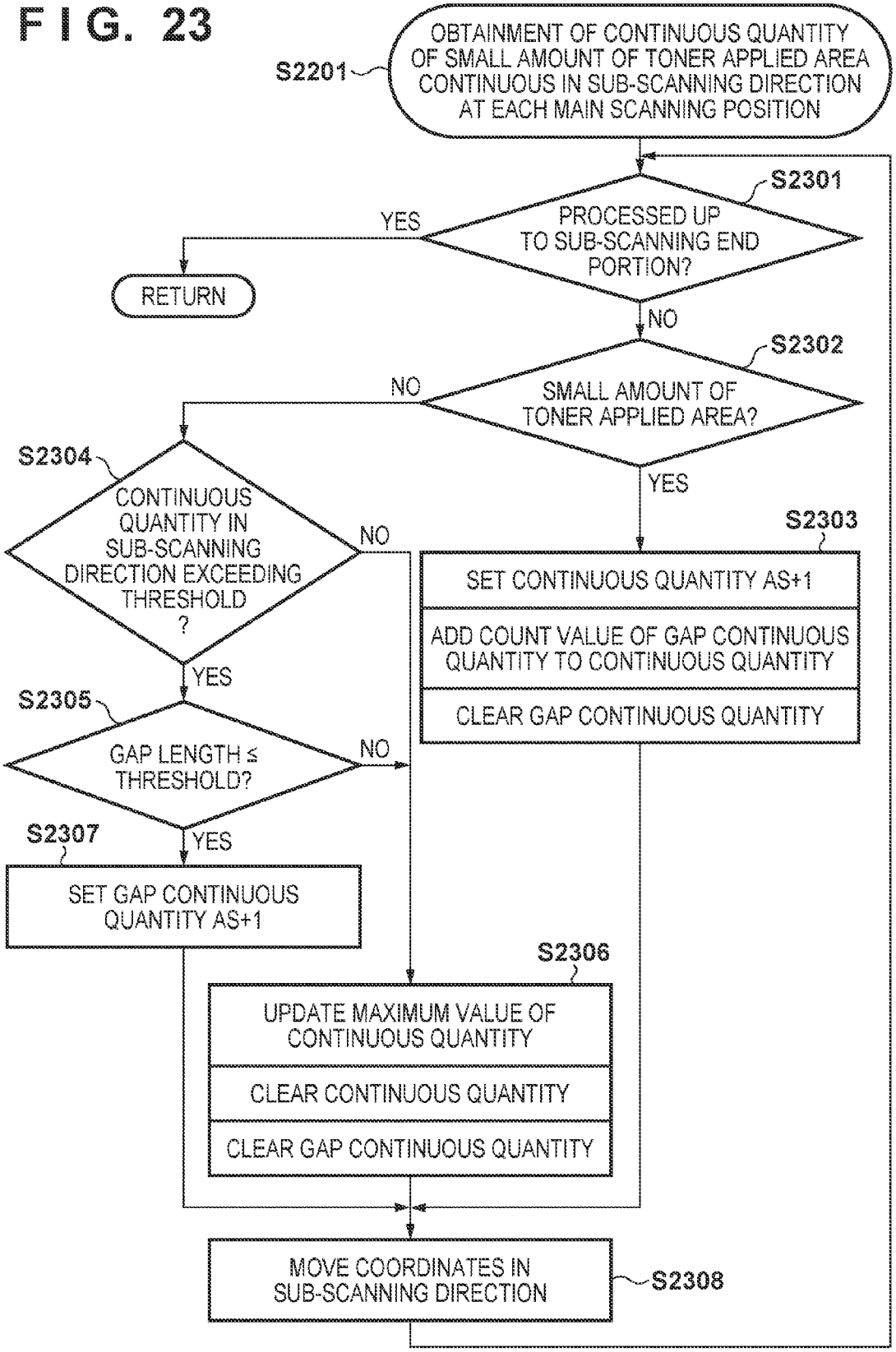
FIG. 23 is a flowchart for describing a process in step S2201 of FIG. 22.

FIG. 23 is a flowchart for describing a process in step S2201 of FIG. 22.

In step S2301, the CPU 210 determines whether or not a sub-scanning position to be processed reaches the end portion of the page in the sub-scanning direction. If the CPU 210 determines that the position reaches the end portion in the sub-scanning direction, this process ends; otherwise, the process advances to step S2302. In step S2302, the CPU 210 determines whether or not PickupTnrAre as a determination result of the local amount of applied toner is "1", that is, the local region is the small amount of toner applied area. If the local region is the small amount of toner applied area, it is judged that the small amount of toner applied area is continuous in the sub-scanning direction, and the process advances to step S2303. On the other hand, if it is not the small amount of toner applied area, the process advances to step S2304 in which it is determined whether the gap is generated in the sub-scanning direction or whether continuity is broken.

When the amount of toner applied area is continuous in the sub-scanning direction, in step S2303, the CPU 210 sets the continuous quantity yRun [main scanning position] of the small amount of toner applied area in the sub-scanning direction as +1. Further, a gap continuous quantity in the sub-scanning direction accumulated so far is added to the sub-scanning continuous quantity yRun [main scanning position] of the small amount of applied toner and is treated as a combined small amount of toner applied area including the gap. That is, yRun [main scanning position]+sukima_yRun [main scanning position]=yRun [main scanning position] is set here. Then, the gap continuous quantity sukima_yRun [main scanning position]=0 is cleared, and the process advances to step S2308.

On the other hand, in step S2304, the CPU 210 sets an area where the small amount of toner applied area to a current sub-scanning position is continuous as the start object and determines whether or not the continuous quantity in the sub-scanning direction at that time exceeds a threshold FirstObjectSizeThre (=10 mm) designated in advance. If the continuous quantity of the start object exceeds the threshold, the process advances to step S2305. If the continuous quantity of the start object does not exceed the threshold, it is judged that the continuity in the sub-scanning direction gets lost, and the process advances to step S2306.

In step S2305, the CPU 210 determines whether or not the continuous quantity of the gap area without the small amount of applied toner is smaller than a threshold sukima_yRunThre (50 mm in the example of FIG. 21) designated in advance. If the gap continuous quantity is small and equal to or smaller than the threshold, the process advances to step S2307 in which the gap continuous quantity is set as +1, advancing to step S2308. On the other hand, if the gap continuous quantity is larger than the threshold, it is judged that the continuity of the small amount of applied toner is broken, and the process advances to step S2306. In step S2306, the CPU 210 stores a maximum value yRunMax [main scanning position] of the sub-scanning continuity in the small amount of toner applied area. More specifically, the maximum continuous quantity yRunMax [main scanning position] and the current continuous quantity yRun [main scanning position] are compared, and the value of the maximum continuous quantity yRunMax [main scanning position] is updated with a larger value. Then, the continuous quantity yRun [main scanning position]=0 is set, the gap continuous quantity sukima_yRun [main scanning position]=0 is cleared, and the process advances to step S2308.

Then, in step S2308, the CPU 210 moves to a next sub-scanning position and refers to the judgment result PickupTnrArea of the local amount of applied toner. Then, the processes in steps S2301 to S2308 are repeated until the process for the end portion in the sub-scanning direction is completed in step S2301.

Figure 21:
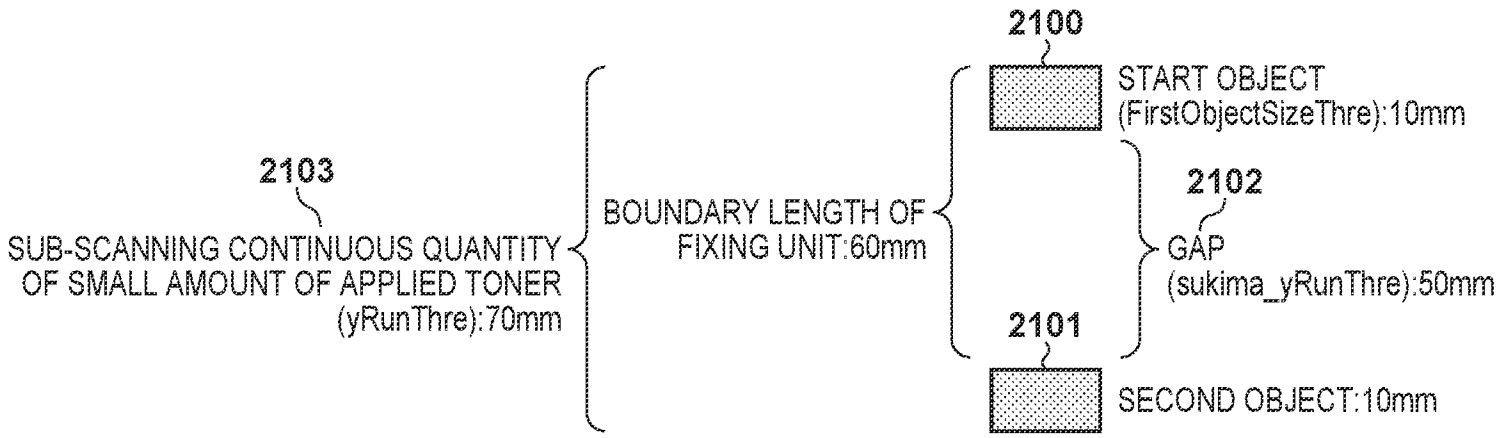
FIG. 21 depicts a view showing two small amount of toner applied areas divided by the boundary length of a fixing unit.

FIG. 21 depicts a view for explaining an example in which the continuity of the small amount of toner applied area in the sub-scanning direction is determined according to the fourth embodiment.

A 50-mm gap 2102 is generated between a start object 2100 of 10 mm×10 mm in the small amount of toner applied area and a next second object 2101 of 10 mm×10 mm. It is determined here whether the length of this gap 2102 exceeds the threshold sukima_yRunThre (50 mm). If the length of the gap 2102 is equal to or smaller than the threshold sukima_yRunThre (50 mm), the start object 2100 and the second object 2101 are treated as continuous. Therefore, in the example of FIG. 21, if the gap 2102 between the start object 2100 and the second object 2101 is 50 mm when the boundary length of the roller of the fixing unit is 60 mm, this region is processed as a small amount of toner applied area 2103 having the area of 10 mm×70 mm.

As described above, it is possible, by performing the process shown in the flowchart of FIG. 23, to treat two small amount of toner applied areas away from each other in the sub-scanning direction as a continuous small amount of toner applied area as shown in, for example, FIG. 21. That is, for FIG. 21, two small amount of toner applied areas away from each other in the sub-scanning direction can be treated as an object with the small amount of toner applied area continuous by 70 mm in the sub-scanning direction.

As described above, according to the fourth embodiment, it is possible to detect a page where the small amount of toner applied area is generated repeatedly at the same position of fixing unit members even if a repetition counter corresponding to the boundary length of the fixing unit members (fixing roller/fixing film) is not provided. This makes it possible to perform temperature control of the fixing unit and cleaning control of a photosensitive member when the image of such a page is formed.

Note that in the fourth embodiment, the description has been given in a case in which there is a gap between a small amount of toner applied regions in the sub-scanning direction. However, the same may also be applied to a case in which there is the gap between small amount of toner applied regions in the main scanning direction. This makes it possible, even in a case in which, for example, there are gaps in the main scanning direction like a dotted thin line, to ignore them and to detect, as an area of the small amount of toner applied area continuous in the main scanning direction, if the length of each gap is equal to or smaller than a threshold.

Other Embodiments

Embodiments of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-089891, filed Apr. 27, 2016, and Japanese Patent Application No. 2016-210837, filed Oct. 27, 2016, which are hereby incorporated by reference herein in their entirety.

What is claimed is:

1. An image forming apparatus comprising:

a transferring unit that transfers toner to a sheet based on image data;

a fixing unit that fixes the toner to the sheet;

a memory device that stores a set of instructions; and at least one processor that executes instructions out of the set of instructions:

to analyze the image data and to detect a first area and a second area in the image data, wherein the first area corresponds to an area of the sheet in which a toner application amount per unit area is greater than a first threshold value and less than a second threshold value, and the second area corresponds to an area of the sheet in which a toner application amount per unit area is greater than a third threshold value that is greater than the second threshold value, wherein the second area is smaller than the first area; and to set a target fixing temperature for fixing the toner to the sheet based on the analyzing of the image data such that the target fixing temperature is set to be higher in a case in which one of the first area and the second area is detected than in a case in which none of the first area and the second area is detected.

2. The image forming apparatus according to claim 1, wherein the at least one processor further executes instructions, out of the set of instructions stored in the memory device, to control cleaning of the fixing unit when image formation is performed based on the analyzing of the image data.

3. The image forming apparatus according to claim 2, wherein the at least one processor further executes instructions, out of the set of instructions stored in the memory device, at a position of the image data in a main scanning direction, based on a quantity of a region having the toner application amount per unit area that is less than the second threshold value that continues in a sub-scanning direction, and a quantity of the region continuous in the sub-scanning direction that continues in the main scanning direction, to obtain an area of the region continuous in the sub-scanning direction and the main scanning direction, and to determine that there is the first area if the area has not less than a predetermined size.

4. The image forming apparatus according to claim 3, wherein the at least one processor further executes instructions, out of the set of instructions stored in the memory device, in consideration of cleaning of the fixing unit, to obtain an area of a continuous toner applied region by giving priority to a continuous quantity of the region continuous in the sub-scanning direction.

5. The image forming apparatus according to claim 3, wherein the second threshold value is defined based on the unit area having a size exceeding at least a millimeter.

6. The image forming apparatus according to claim 2, wherein the at least one processor controls a frequency at which cleaning of the fixing unit is performed.

7. The image forming apparatus according to claim 1, wherein the at least one processor further executes instructions, out of the set of instructions stored in the memory device to calculate a halftone-dot rate from a number of pixels included in a local region of the image data and to obtain an amount of the toner in the first area from the halftone-dot rate.

8. The image forming apparatus according to claim 1, further comprising a humidity sensor that detects a humidity value, wherein the at least one processor sets a first fixing temperature regardless of the humidity value detected by the humidity sensor in a case in which the second area is detected, and sets a second fixing temperature that is greater than the first fixing temperature based on the humidity value detected by the humidity sensor in a case in which the second area is not detected and the first area is detected.

9. The image forming apparatus according to claim 8, wherein, when the humidity value sensed by the humidity sensor does not indicate a high-humidity environment, the at least one processor increases a frequency at which cleaning of the fixing unit is performed by a predetermined amount.

10. The image forming apparatus according to claim 9, wherein the at least one processor further executes instructions, out of the set of instructions stored in the memory device, to determine whether or not a region having the toner application amount per unit area that is less than the second threshold value, and a region having the toner application amount per unit area that is greater than the second threshold value are mixed, and, when it is determined that the regions are mixed and the humidity value sensed by the humidity sensor does not indicate a high-humidity environment, to increase the frequency at which cleaning of the fixing unit is requested by the predetermined amount.

11. The image forming apparatus according to claim 8, wherein the at least one processor further executes instructions, out of the set of instructions stored in the memory device, to determine whether or not a region having the toner application amount per unit area that is less than the second threshold value, and a region having the toner application amount per unit area that is greater than the second threshold value are mixed, and, when it is determined that the regions are mixed and the humidity value sensed by the humidity sensor indicates a high-humidity environment, to increase a temperature of the fixing unit by a predetermined amount.

12. The image forming apparatus according to claim 1, wherein the at least one processor further executes instructions, out of the set of instructions stored in the memory device, to calculate a toner application amount per unit area in a local region, and, if the calculated toner application amount per unit area is not less than the first threshold value, and is less than the second threshold value, to count the continuous number of times of the first area at each position of fixing unit coordinates mapped to the fixing unit, and to set the fixing temperature based on an area of a continuous region in which it is determined that the first area is continuous a plurality of times at the fixing unit coordinates.

13. The image forming apparatus according to claim 12, wherein the at least one processor further executes instructions, out of the set of instructions stored in the memory device, to perform calculation as an area of the continuous regions, even if a gap exists between the first area and second area, if the gap is not more than a predetermined threshold.

14. The image forming apparatus according to claim 13, wherein the predetermined threshold of the gap has a value based on a boundary length of a fixing roller of the fixing unit.

* * * * *